US006286215B1

(12) United States Patent
Panaccione

(10) Patent No.: US 6,286,215 B1
(45) Date of Patent: Sep. 11, 2001

(54) RETRACTABLE BLADE SCRAPER

(75) Inventor: Mark T. Panaccione, Beaverton, OR (US)

(73) Assignee: Hyde Manufacturing Company, Southbridge, MA (US)

( * ) Notice: Subject to any disclaimer, the term of this patent is extended or adjusted under 35 U.S.C. 154(b) by 0 days.

(21) Appl. No.: 09/332,329

(22) Filed: Jun. 14, 1999

(51) Int. Cl.[7] ..... B26B 1/00
(52) U.S. Cl. ..... 30/169; 30/335
(58) Field of Search ..... 30/169, 335, 336, 30/162, 125, 30; 15/236.01

(56) References Cited

U.S. PATENT DOCUMENTS 4,955,138 * 9/1990 Henke et al. ..... 30/335
5,433,004 * 7/1995 Thompson et al. ..... 30/169

* cited by examiner

*Primary Examiner*—Douglas D. Watts
(74) *Attorney, Agent, or Firm*—Louis J. Franco

(57) ABSTRACT

A retractable blade scraper includes an elongated handle having an upper surface, a lower surface, a left side, a right side, an open forward end and a rear end. Included in the handle is an integral blade slide housing that begins at the open forward end and extends longitudinally rearwardly toward the rear end of the handle. Slidably received and retained in the housing is a blade slide with a blade platform for removably retaining a scraping blade such that its scraping edge is substantially perpendicular to the longitudinal axis of the handle. The blade slide is longitudinally reciprocable within the housing between a forwardmost blade-changing position in which the blade platform extends out of the housing, beyond the open forward end, by an amount sufficient to permit the removal and replacement of scraping blades therefrom and thereon and a rearwardmost blade-storage position in which the scraping edge of a scraping blade in place on the blade platform is housed within the housing for safety. The blade slide includes a resilient lever and a force actuated thumb button connected to the lever, which thumb button is accessible to a user from the exterior of the handle, and longitudinally reciprocable, through an elongated thumb button opening in the handle. Depending from the resilient lever is a slide-locking detent. The slide-locking detent is normally biased by the resilient lever in a lateral direction for alternative locking engagement with at least first and second detent-receiving notches corresponding to the storage position and a scraping position. The slide-locking detent is movable out of engagement with the detent-receiving notches, so that the blade slide can be reciprocated within the handle, by the substantially lateral depression of the thumb button against the biasing force of the resilient lever.

20 Claims, 22 Drawing Sheets

RETRACTABLE BLADE SCRAPER

FIELD OF THE INVENTION

This invention relates generally to blade scrapers used for removing paint, glue, caulking, adhesives, tape, stickers or other materials from surfaces, particularly, hard, smooth surfaces, such as glass and tile. Specifically, the invention relates to a scraper wherein the scraping blade is alternately retractable into a housing for storage, and extendible from the housing for use or replacement.

BACKGROUND

There are numerous scraping tools on the market, many of which are the subject matter of patents. Such patents include U.S. Pat. No. 4,955,138 to Henke; U.S. Pat. No. 2,291,514 to Warner and Tessmer; U.S. Pat. No. 3,855,700 to Gerson and Caprio; U.S. Pat. No. 4,558,517 to Gringer; U.S. Pat. No. 5,433,004 to Thompson and Henke; U.S. Design Pat. No. 282,881 to Gringer and U.S. Design Pat. No. 346,319 to Lavallee et al.

Some previous scrapers provide for alternately retracting and extending scraping blades. Of these, some include blade holders with vertically depressable buttons which, when depressed, release the blade holder from any of a number of locking positions for longitudinal reciprocation within a housing for alternate extension and retraction of a scraping blade through an opening in the housing.

SUMMARY

The present invention relates to a retractable blade scraper which utilizes a scraping blade for removing paint, glue, caulking, adhesives, tape, stickers or other materials from surfaces, particularly, hard, smooth surfaces, such as glass and tile.

In one embodiment, a retractable blade scraper is adapted to receive and utilize a trapezoidal utility knife blade, while in an alternative embodiment, a retractable blade scraper is adapted to utilize a rectangular scraping blade.

One embodiment of a retractable blade scraper includes a handle having an upper surface, a lower surface, a left side, a right side, an open forward end and a rear end opposite the open forward end. Proximate its open forward end, the handle includes an integral blade slide housing that begins at the open forward end and extends longitudinally rearwardly toward the rear end of the handle. The blade slide housing is bounded by top, bottom, left and right walls that define an interior blade-slide cavity designed to receive and house a utility knife blade.

The retractable blade scraper further includes a blade slide which is slidably received and retained in the blade slide housing and which includes a blade platform designed to removably receive and retain the scraping blade, with its scraping edge extending substantially perpendicularly to the longitudinal axis of the handle, for longitudinal reciprocation into and out of the open forward end of the handle and housing between a forwardmost blade-changing position and a rearwardmost blade storage position. The forwardmost blade-changing position is such that the blade platform extends out of the blade-slide cavity beyond the open forward end by an amount sufficient to permit the removal and replacement of scraping blades therefrom and thereon. The rearwardmost blade-storage position is such that the scraping edge of a scraping blade in place on the blade platform does not extend beyond the open forward end.

The blade slide further includes a resilient lever and a force actuated thumb button connected to the resilient lever.

Depending from the resilient lever is a slide-locking detent. The slide-locking detent is normally biased by the resilient lever for alternative locking engagement with at least a first detent-receiving notch within the handle corresponding to the blade storage position and a second detent-receiving notch within the handle corresponding to a scraping position. The scraping position lies between the storage and blade changing positions and is such that the scraping edge of a scraping blade properly in place on the blade platform extends beyond the open forward end of the handle for use. The slide-locking detent is movable into a sliding position in which it is disengaged from the detent-receiving notches by the depression of the thumb button, against the biasing force of the resilient lever, in a substantially lateral direction toward one side of the handle so that the blade slide may be longitudinally reciprocated between the blade-changing and storage positions. In one version, the blade-changing position is, a locking position. In version in which the blade-changing position is a locking position, a third detent-receiving notch may be provided within the handle that corresponds to the blade-changing position.

In one version, the handle and blade slide housing are substantially symmetrical about the longitudinal axis of the handle when viewed from either the left or right side. Furthermore, the upper and lower surfaces of the handle are tapered toward one another in the vicinity of the open forward end, thereby permitting a user to obtain a favorable angle of approach (e.g., less than 24°) between the blade and the surface to be scraped, facilitating efficient removal of the unwanted material on the surface being scraped, whether the scraper is held with its upper surface up or down. Another advantage of the scraper's symmetry and minimal thickness of preferably less than 9/16" is that, when one side of the blade's scraping edge becomes worn, the user can simply turn the scraper over so that the other side of the blade's scraping edge may be put into contact with the surface to be scraped. This same feature is equally applicable when a blade corner becomes chipped or worn. This feature eliminates the need for the user to remove the blade from the blade platform, turn the blade over, and reinstall it on the blade platform. The symmetry of a version intended for use with its upper surface either face up or face down, renders the designation of upper and lower surfaces arbitrary.

In one version, a significant advantage of the first is provided by the location of the thumb button. Existing scrapers with retractable blades have thumb buttons projecting through a thumb button opening located at or near the center of the top surface of the handle as illustrated, for example, in U.S. Pat. No. 4,955,138 to Henke and U.S. Pat. No. 4,558,517 to Gringer. In these prior scrapers, the user actuates the blade slide with his or her thumb or index finger by pushing downwardly on the thumb button in a substantially vertical direction toward the lower surface of the handle or housing in order to disengage it from a locked position. The user may then slide the blade slide either forward or backward depending on the desired blade position. On one version of the present scraper, the thumb button is located to one side of the center of the upper surface of the handle and slides forward and backward in a thumb-button opening that is located partially in one side of the scraper handle and partially in the adjacent portion of the upper surface of the scraper. It makes no difference whether the thumb button and its thumb button opening are on the left or right side of the scraper and, in actuality, either location is accommodating to both right-handed and left-handed users. In contrast to the thumb buttons of its predecessors, the thumb button of the present scraper is actuated by depressing it with thumb or index finger in a lateral direction substantially toward the side surface opposite the side surface having the thumb button opening, substantially along a plane lying between the upper and lower surfaces of the tool. In other words, the direction in which the thumb button is depressed in the present scraper to disengage it from a locked position is roughly 90° out of alignment with the direction of depression of the thumb buttons in prior scraper; instead of pushing generally vertically downward on the thumb button, the user pushes generally laterally toward one side of the scraper. Another advantage of the location and direction of depression of the thumb button in the present scraper is that the thumb button is located very near the natural position of the user's thumb or index finger when the user is scraping a surface. Furthermore the direction of depression of the thumb button is in alignment with the natural direction of force applied by the user's thumb or index finger when the user is gripping the scraper for scraping, so that the user is not required to reposition the scraper in his or her hand in order to access and actuate the thumb button.

It warrants stating to avoid an unintended narrow reading of the specification and claims, that the description of the directions of depression of the thumb buttons of the present scraper and of prior scrapers, as being along planes that are perpendicular to one another is for purposes of general explanation. The actual directions of depression of any of these thumb buttons may not lie neatly in a well-defined plane, and they could twist and deviate during depression by up to several degrees.

In connection with certain substantially symmetric versions, it will be appreciated that whether the user chooses to use his or her left or right, thumb or index finger to depress the thumb button of the present invention is a matter of personal preference since, whether the scraper is constructed with the button on the left or right side, the user need only turn the scraper over in his or her hand to orient the thumb button in the preferred position.

BRIEF DESCRIPTION OF THE DRAWINGS

The above and other functions, features and advantages of the present invention will be more fully understood and appreciated through the following detailed description in conjunction with the accompanying drawings, wherein like reference numerals indicate corresponding elements throughout each of the views depicted and in which.

Depicted in FIGS. 11 through 14C are views of an alternative version of a retractable blade scraper of the invention, the principal difference between the two embodiments being that the first preferred embodiment is adapted for use with a trapezoidal utility blade while the adapted for use with a rectangular scraping blade.

Figure 11:
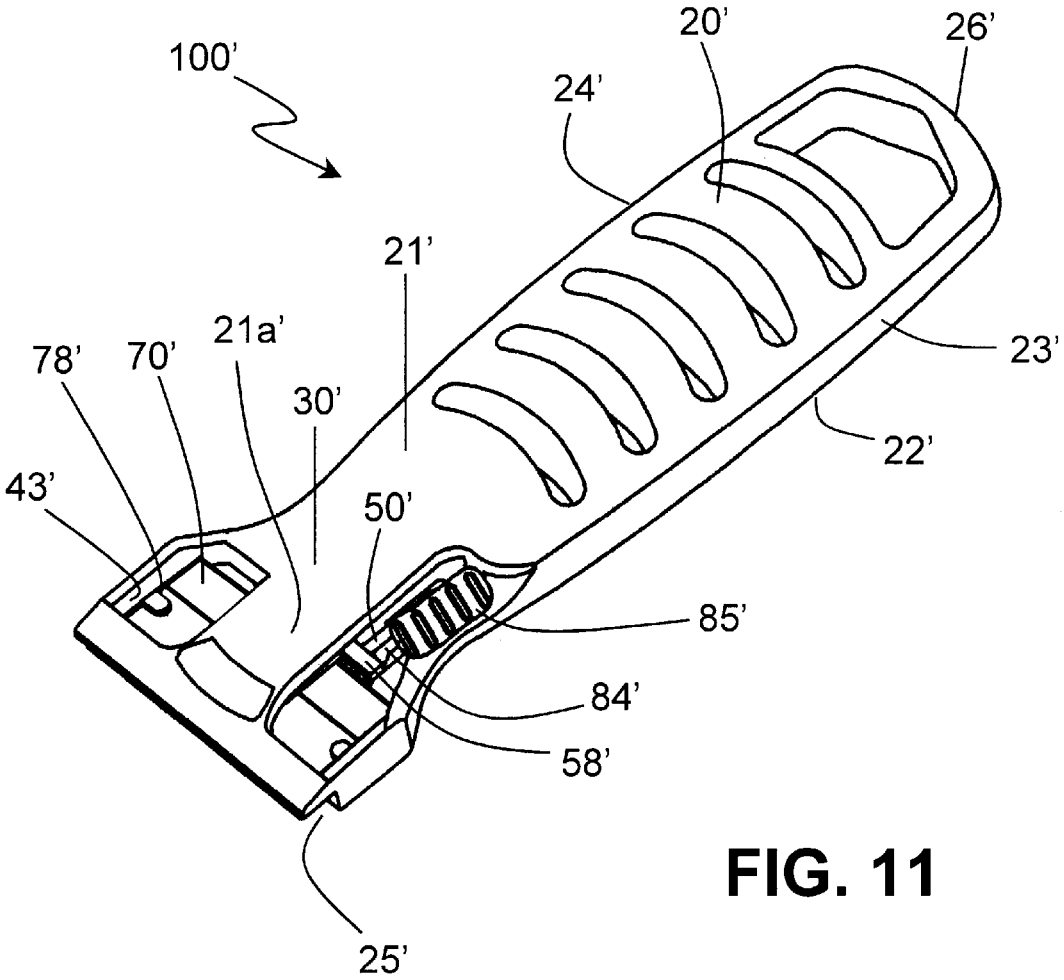
Figure 12:
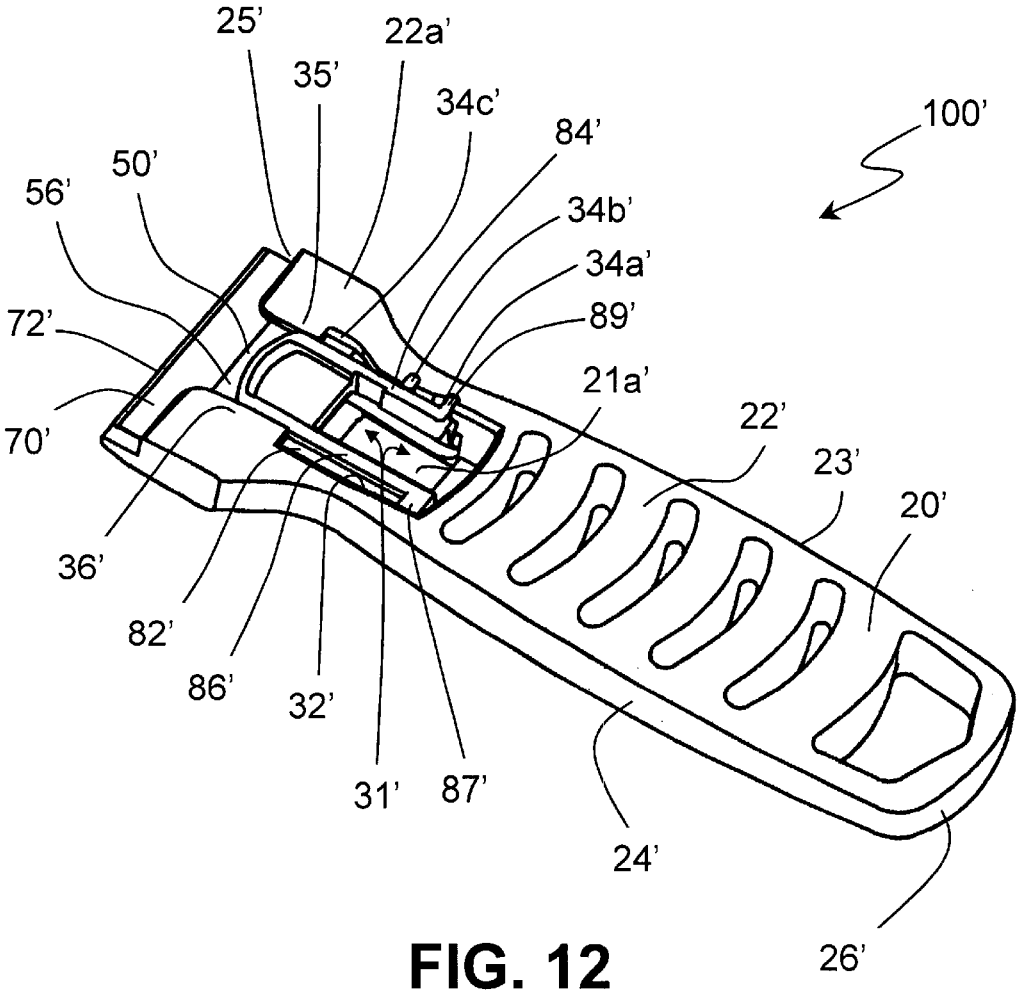
Figure 13:
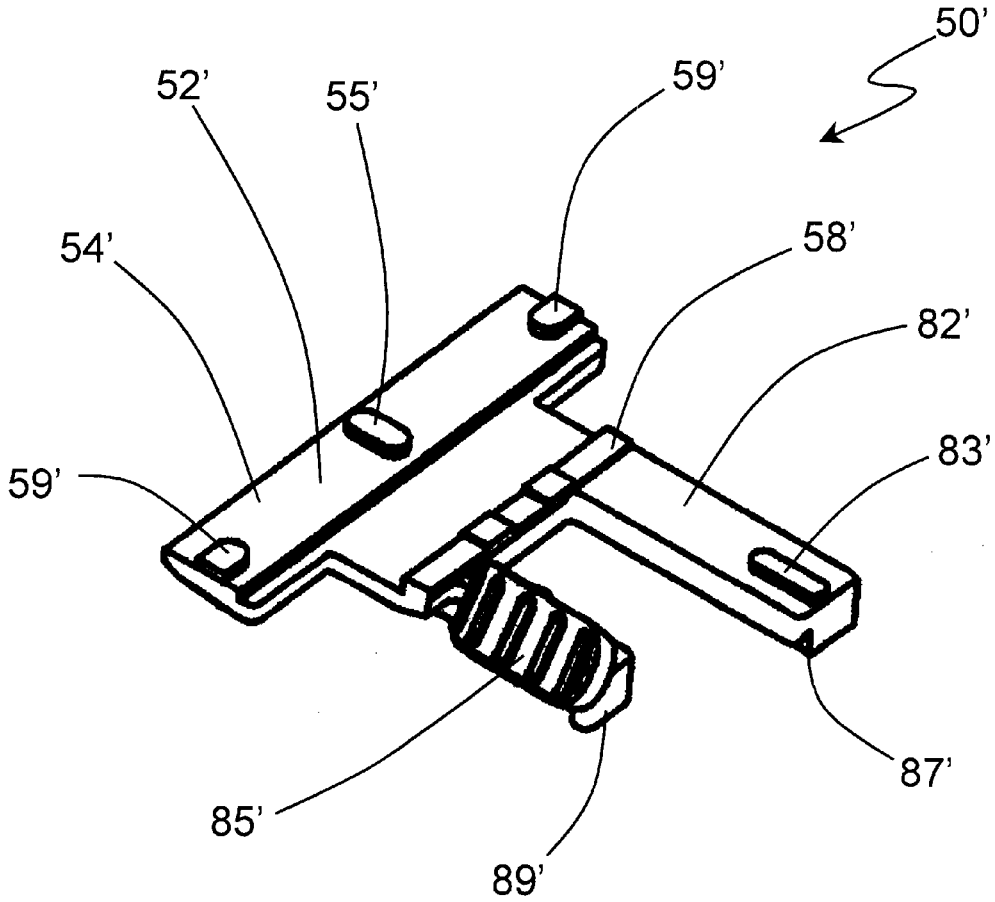
Figure 14A:
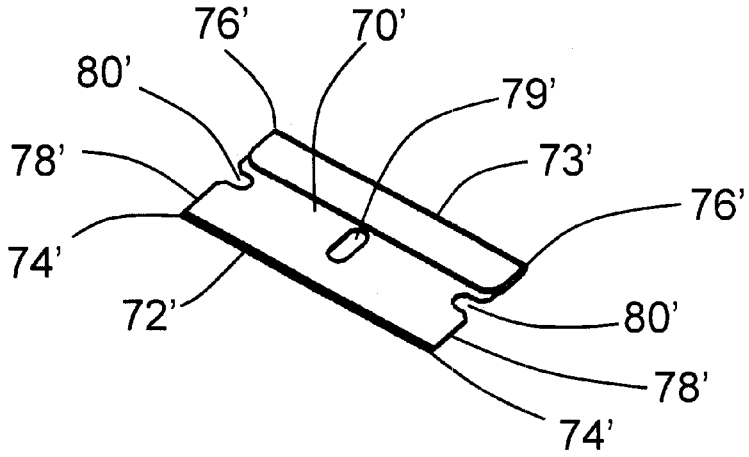
Figure 14B:
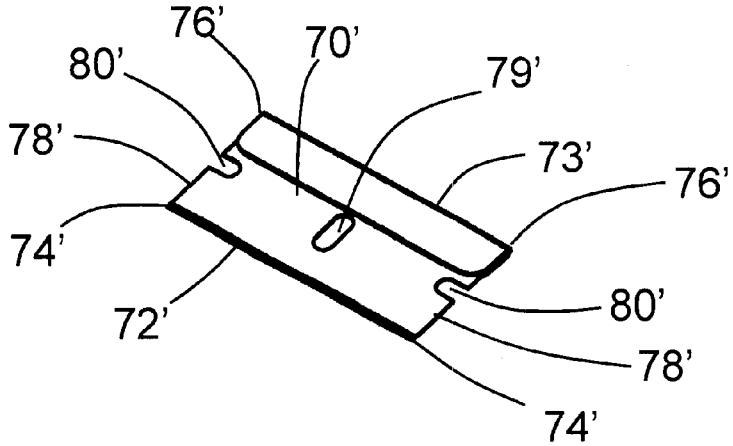
Figure 14C:
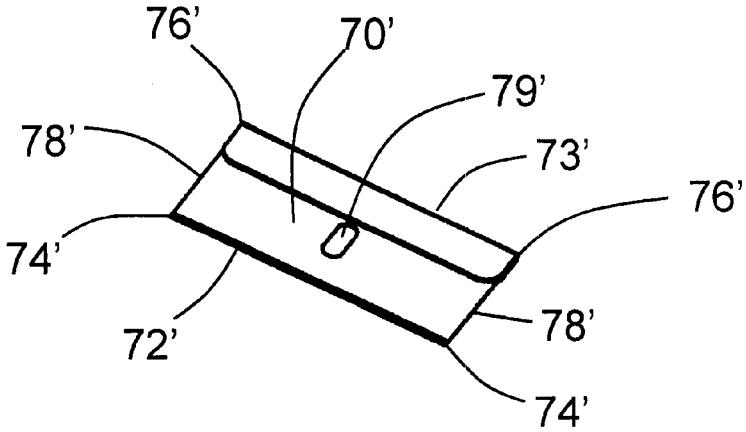

FIG. 11 is a top perspective view an alternative version of a retractable blade scraper as viewed from the front and left side;

FIG. 12 is a bottom perspective view of the embodiment depicted in FIG. 11 as viewed from the rear and right side;

FIG. 13 is a top perspective view of the blade slide component of the blade scraper depicted in FIG. 11 as viewed from the rear and left side;

FIGS. 14A–14C are top perspective views of illustrative rectangular scraping blades having different illustrative configurations.

DETAILED DESCRIPTION

The following description of a retractable blade scraper is demonstrative in nature and is not intended to limit the scope of the invention or its application of uses.

Referring to the drawings, specifically FIGS. 1 through 10B, there is illustrated an embodiment of a retractable blade scraper 100 (hereinafter "scraper") adapted for use with a trapezoidal utility blade 70. The two main cooperating components of the scraper 100 are a handle 20 and a blade slide 50. The handle 20 has an upper surface 21, a lower surface 22, a left side 23, a right side 24, an open forward end 25, and a rear end 26. The handle 20 includes a blade slide housing 30 beginning at the forward end 25 and extending rearwardly toward the rear end 26. The blade slide housing 30 defines an interior blade-slide cavity 31 designed to slidably receive and retain the blade slide 50 (shown separately in FIGS. 6A through 6H) with a utility blade 70 removably mounted thereon.

The blade slide 50 and the handle 20 cooperate as follows. The blade slide 60 is slidably received in the blade slide housing 30 and normally retained for longitudinal reciprocation therein between a forwardmost blade-changing position and a rearwardmost blade-storage position. Located between the blade-changing and blade-storage positions is a scraping position. In one embodiment, the blade slide 50 is selectively lockable in at least its blade-storage and scraping positions. The longitudinal reciprocation of the blade slide 50 between its blade-changing and blade-storage positions, and the locking thereof into at least the storage and scraping positions, is facilitated by a thumb button 85 that is accessible from the exterior of the handle 20 and connected to the remainder of the blade slide 50 by a resilient lever 84 as shown, for example, in FIGS. 1, 3 and 6A through 6H. Depending from the resilient lever 84 is a slide-locking detent 89 which is movable into and out of the detent-receiving notches 34*a* and 34*b* in the handle 20 between a locking position and a sliding position. In the version shown in FIG. 2, the detent-receiving notches 34*a* and 34*b* correspond to the blade storage and scraping positions respectively. The resilient lever 84 is biased so as to maintain the slide-locking detent 89 in one of the detent-receiving notches 34*a* and 34*b* (i.e., in the locking position). The thumb button 85 is depressible, and the resilient lever flexible, in a lateral direction toward one side of the handle 20 into the sliding position in which the slide-locking detent 89 is disengaged from the detent-receiving notches 34*a* and 34*b* so that the blade slide 50 can be longitudinally reciprocated forward and backward within the blade slide housing 30.

Having described the fundamental components and functions of an embodiment, details of the same are now described with greater specificity.

The Blade Slide

One embodiment of a scraper 100 is adapted for use with a substantially flat, trapezoidal utility blade 70 (FIGS. 7A and 7B) having two opposed flat surfaces, a forward scraping edge 72, a rear edge 73, which is opposite and parallel to the forward scraping edge 72, acute corners 74 at the extremes of the scraping edge 72, obtuse corners 76 at the extremes of the rear edge 73, and diverging side edges 78 extending forward from the obtuse corners 76 to the acute corners 74.

In the version illustrated, the utility blade 70 further has at least one lug-engaging aperture 79 located at approximately its geometric center and a pair of spaced blade-shoulder cutouts 80 near the center of the rear edge 73. Of course, one or more of each of a lug-engaging aperture 79 or a blade-shoulder cutout 80 could be located anywhere through the two opposed flat surfaces or any of the rear edge 73 and diverging side edges 78, respectively. The configurations illustrated are common industry examples.

The utility blade 70 is removably mountable on a blade seat 52 of the blade slide 50. As illustrated best in FIGS. 6A through 6H, the blade seat 52 has a blade platform 54 and a rear wall 58 for receiving and supporting one of the flat surfaces of the utility blade 70 and the rear edge 73 of the blade 70, respectively. The blade platform 54 is preferably provided with at least one blade-retaining lug 55 designed to project through and engage the at least one lug-engaging aperture 79 to prevent the utility blade 70 from sliding relative to the blade platform 54. Also assisting in this restraining function are blade shoulders 59 which, in this case, project forward from the rear wall 58 and are spaced apart to engage the blade-shoulder cutouts 80 of the utility blade 70. An alternative configuration for the lug-engaging aperture 79 is shown in FIG. 7B by way of example. The locations of the lug-engaging apertures 79 and blade-shoulder cutouts 80 in the blade 70 correspond with the locations of the blade-retaining lugs 55 and blade-shoulders 59 included on the blade slide 50 for restraining engagement respectively therewith.

Extending rearwardly from the blade seat 52 are a substantially rigid guide arm 82 and resilient lever 84, which are spaced apart and normally in substantial parallel alignment with one another. Extending along a bottom surface 56 of the blade slide 50, beginning at a point below the blade platform 54 and terminating at the end of the rigid guide arm 82 is an arm rail 86 which extends substantially parallel to a longitudinal axis of the blade slide 50. The resilient lever 84 is further connected to the thumb button 85 as previously stated. In the example illustrated in the rear view of FIG. 6F, the thumb button 85 extends upward and outward to the left hand side of the blade slide 50 at an angle of approximately 35° with respect to the plane in which the top surfaces of the rigid arm 82 and the resilient lever 84 lie. While an angle of 35° has been determined to be ergonomically advantageous by the inventor, an angle of 35° is certainly not necessary and this angle should not be interpreted as a limitation on the scope and spirit of the invention. Furthermore, it will be appreciated that the thumb button 85 and the resilient lever 84 could be to the right of the longitudinal axis of the blade slide 50 with the rigid guide arm 82 on the left.

It should also be noted that the thumb button 85 has a narrow base portion, or stem, and a relatively wide top portion. The reason for the narrow stem connecting the wide top portion of the button 85 to the resilient lever 84 will become apparent further in this description, but it is indicated in this version by the manner in which the blade slide 50 is carried by the handle 20. Specifically when the blade slide 50 and the handle 20 are joined to form the scraper 100, the only portions of the blade slide 50 that protrude from the handle 20 are a portion of the blade seat 52 and the top wide portion of the thumb button 85.

At the rear of the top surface of the rigid guide arm 82 is an upwardly protruding guide-arm lug 83, the functionality of which is discussed infra.

The Handle

Figure 8A:
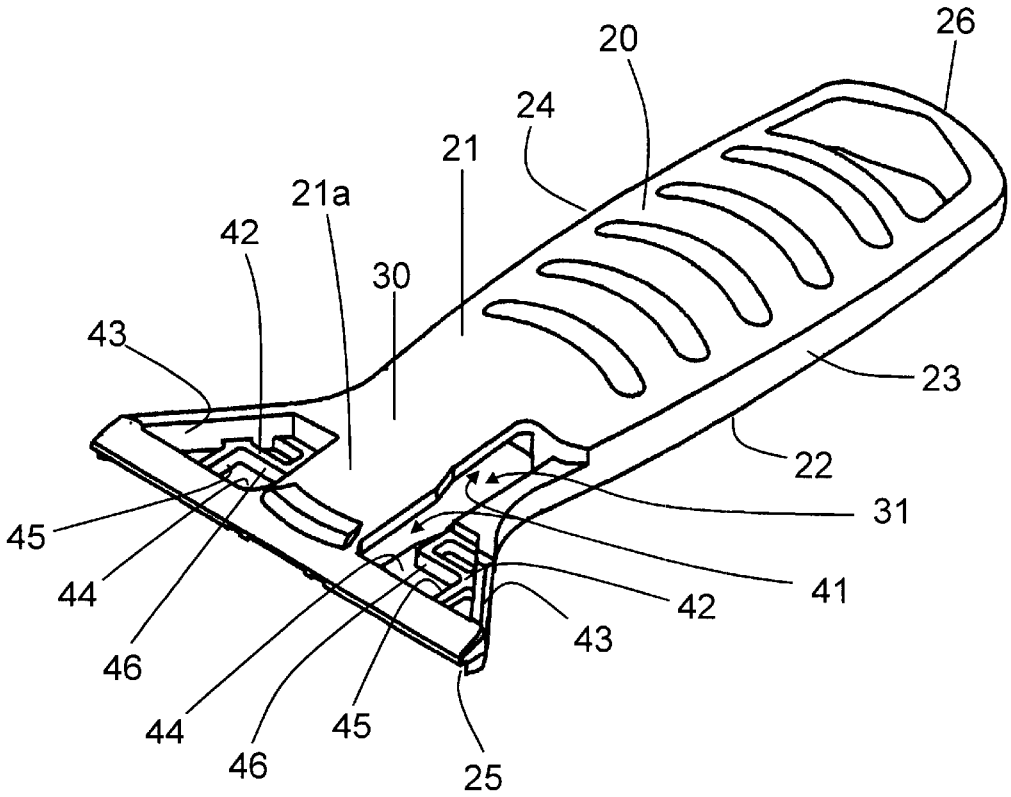
FIG. 8A is a top perspective, front end and left side view of the handle component of the embodiment depicted in FIG. 1 without the blade slide mounted therein.
Figure 8B:
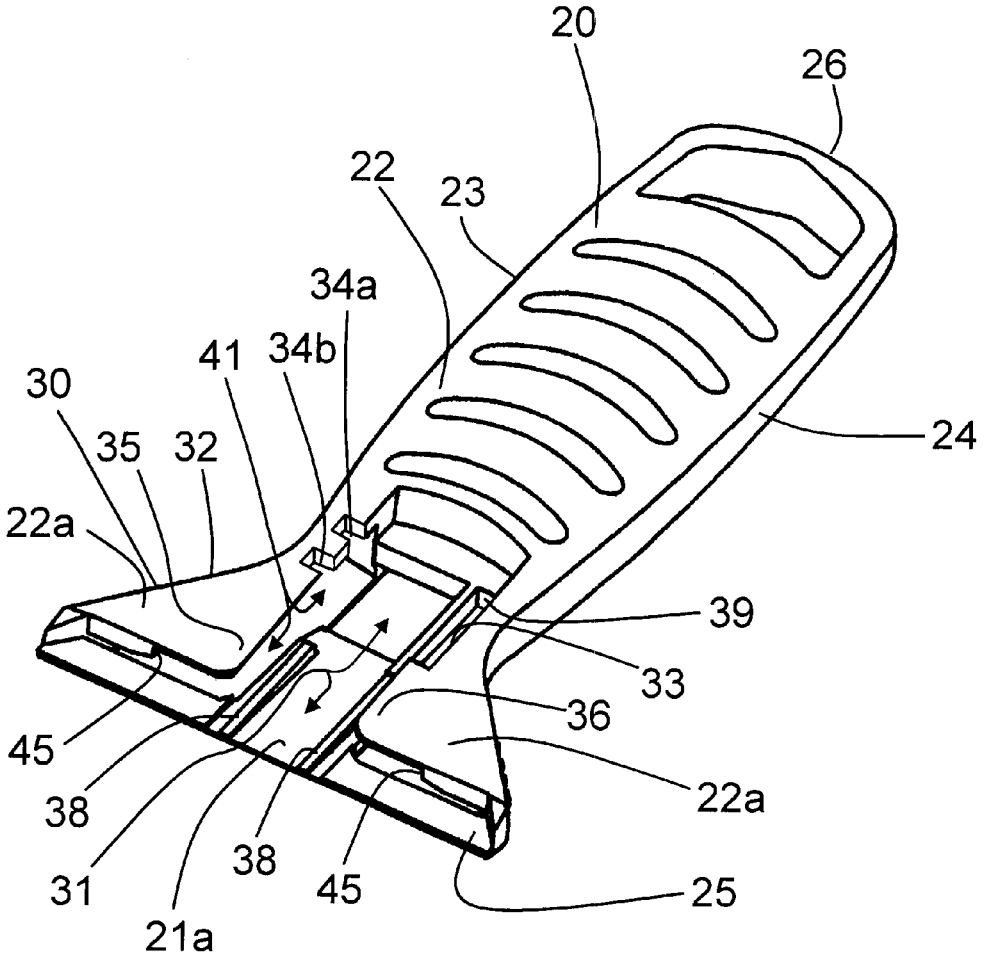
FIG. 8B is a bottom perspective, front end and right side view of the handle component depicted in FIG. 8A without the blade slide mounted therein.

Referring to FIGS. 8A and 8B, the handle 20 of a blade scraper 100 is shown with the blade slide 50 removed therefrom. FIG. 8B shows a bottom view of the handle 20. The lower surface 22 of the handle 20 is open and reveals the interior blade-slide cavity 31 which extends rearwardly from the open forward end 25 of the handle 20 to the back of the blade slide housing 30. The blade slide housing 30, and the blade-slide cavity 31 therein, is defined by a right side wall 32, a left side wall 33, a top wall 21*a* and a bifurcated bottom wall 22*a*, the exterior surfaces of which top and bottom walls 21*a* and 22*a* form a part of the upper and lower surfaces 21 and 22 of the handle 20, respectively. A portion of the bottom wall 22*a* extends inwardly beyond the right side wall 32. This portion of the bottom wall 22*a* is provided with detent-receiving notches 34*a* and 34*b* and, furthermore, defines a resilient-lever guide 35 for slidably guiding the resilient lever 84. The detent-receiving notches 34*a* and 34*b* correspond to the blade storage and blade scraping positions, respectively. Another portion of the bottom wall 22*a* extends inwardly beyond the left side wall 33 near the forward end 25 and defines a rigid-rail guide 36 for slidably guiding the arm rail 86.

Disposed in spaced parallel relationship with each other, along the inside of the top wall 21*a* of the blade slide housing 30, are slide tracks 38 along which the top surfaces of the rigid guide arm 82, the resilient lever 84, and the rear wall 58 of the blade slide 50 slide as the blade slide 50 is moved forward and backward within the blade slide housing 30. When the utility blade 70 is installed on the blade platform 54, its top flat surface is in roughly the same plane as the top of the rear wall 58 of the blade seat 52 and may also slide along the slide tracks 38. Located between the right slide track 38 and the right side wall 32 is a guide-arm-lug channel 39 for receiving and slidably guiding the guide-arm lug 83 that protrudes upwardly from the top surface of the rigid guide arm 82.

Located at least partially in the top wall 21*a* of the blade slide housing 30 and, in the particular case illustrated, the left side 23 of the handle 20 is an elongated thumb button opening 41 through which the thumb button 85 is accessed. The thumb button opening 41 permits longitudinal reciprocation of the thumb button 85 for sliding movement of the blade slide 50 between its blade changing and storage positions. Also visible in a top view of the handle 20 (FIGS. 8A, 9A–9D and 10A) are blade-guiding surfaces 42 for slidably guiding and supporting the bottom flat surface of a utility blade 70 installed on the blade platform 54 of the blade slide 50. The blade-guiding surfaces 42 are bounded in part by diverging-inner-side-wall surfaces 43 that are designed to accommodate the diverging side edges 78 of a trapezoidal utility blade 70. Disposed below the blade-guiding surfaces 42 are blade-seat-guiding surfaces 44 which slidably guide and support the bottom surface 56 of the blade slide 50. Perpendicular to the blade-guiding surfaces 42 and blade-seat-guiding surfaces 44, and extending vertically between the same, are blade-seat-guiding walls 45 and blade-seat-arresting walls 46.

Referring now to FIGS. 8A and 8B, which illustrate the handle 20 without the blade slide 50 mounted therein; FIGS. 6A through 6H, which depict the blade slide 50 apart from the handle 20; and FIGS. 1 through 5, 9A through 9E, and 10A and 10B, which depict the assembled scraper 100 from various angles with the blade slide 50 in its storage, scraping, and changing positions, it can be seen how the blade slide 50 is slidably received and mounted in the blade slide housing 30. The right side wall 32, left side wall 33, resilient-lever guide 35, rigid-rail guide 36, slide tracks 38, guide-arm lug channel 39, blade-seat-guiding surfaces 44 and blade-seat-guiding walls 45, all being elements of the handle 20, and the guide-arm lug 83, arm rail 86, seat stop 87, and the slide-locking detent 89, all being elements of the blade slide 50, contribute to the functions of removably retaining and slidably guiding the blade slide 50 within the blade slide housing 30. The top of the rear wall 58 of the blade seat 52 and the top surfaces of the rigid guide arm 82 and the resilient lever 84 of the blade slide 50 slide along the slide tracks 38. In normal use, the blade slide 50 is longitudinally reciprocable between two extreme positions within the blade slide housing 30: a storage position in which the blade slide 50 and the utility blade 70 are completely within the blade slide housing 30 and the slide-locking detent 89 of the resilient lever 84 is biased into detent-receiving-notch 34*a* of the blade slide housing 30, and a blade-changing position in which the blade slide 50 is as far forward as it can move within the blade slide housing 30 so that the utility blade 70 may be lifted up and forward to dismount it from the blade platform 54 and a new utility blade 70 mounted thereon. Optionally, a third detent-receiving notch 34*c* corresponding to the blade-changing position may be provided in the blade slide housing 30. Where a third detent-receiving notch 34*c* is so provided, the slide-locking detent 89 is biased into the detent-receiving-notch 34*c* when the blade slide 50 is in its blade-changing position. Although, it is preferred that the blade-storage and blade-scraping positions be locking positions, the blade-changing position need not be a locking position. In the version shown in FIG. 10B, the detent-receiving notch 34*c* is such that the blade-changing position is not a locking position. Specifically, the detent-receiving notch 34*c* is ramped to provide some resistance to the rearward movement of the blade slide 50 when it is in its blade-changing position, but not so much that the thumb button 85 need be depressed to move the blade slide 50 longitudinally rearward. To make the detent-receiving notch 34*c* such that the blade-changing position is a locking position, the detent-receiving notch 34*c* would not be ramped as shown in FIG. 10B, but rather would be substantially similar in shape to the detent-receiving notches 34*a* and 34*b*.

When the blade slide 50 is in the storage position, the bottom surface 56 of the blade slide 50 is in contact with the blade-seat-guiding surfaces 44 of the blade slide housing 30 and the blade slide 50 is prevented from translating further backward by the contact of the blade-seat-arresting walls 46 in the blade slide housing 30 with the rear edge 57 of the blade seat 52. To actuate and move the blade slide 50 forward within the blade slide housing 30, the user of the scraper depresses the thumb button 85, against the biasing action of the resilient lever 84, until the slide-locking detent 89 is disengaged from whichever of notch 34*a* and 34*b* it is in when actuation is begun. When the thumb button 85 is depressed and the slide-locking detent 89 is disengaged from the detent-receiving notches 34*a,b,* and *c,* the blade slide 50 can be longitudinally reciprocated forward and backward within the blade slide housing 30. When the desired position for the blade slide 50 has been reached, the user releases the thumb button 85 and the biasing action of the resilient lever 84 urges the slide-locking detent 89 to rest in one of the detent-receiving notches 34*a,b* and *c*. When the blade slide 50 is mounted within the housing 30, the thumb button 85 is depressed, and the resilient lever 84 flexes, in a substantially lateral direction; that is, along a path having a primary component of displacement that is perpendicular to a first plane containing the longitudinal axis of the blade slide 50 which first plane is perpendicular to a second plane containing the blade platform 54 of the blade seat 52. It is recognized by the inventor, and will be appreciated by those of ordinary skill in the art, that the path of depression of the thumb button 85 may not lie strictly in a plane and that its motion during depression may be described with the use of Cartesian coordinates in three dimensions wherein the path of depression would have a vector component lying along each of the x,y, and z axes in standard Cartesian notation as designated in FIG. 6H which shows Cartesian coordinate axes superimposed over the blade slide 50. The directions along the x-axis and y-axis in which the thumb button 85 is displaced during depression are indicated by vectors ΔX and ΔY. For the purpose of illustrating what is meant by a "path of depression having a primary component of displacement that is perpendicular to a first plane containing the longitudinal axis of the blade slide 50 which first plane is perpendicular to a second plane containing the blade platform 54 of the blade seat 52," the following designations are given to describe the three Cartesian axes as they relate to the blade slide 50 and blade seat 62. The y-axis is the longitudinal axis of the blade slide 50 so that any component of displacement of the thumb button 85 forward or backward during depression may properly be described in terms of a vector lying along the y-axis. The x-axis intersects the y-axis at a 90° angle and defines a plane therewith; the lateral component of the displacement of the thumb button 85 during depression is described in terms of a displacement vector lying along the x-axis. The z-axis is perpendicular to the plane defined by the x and y axes and intersects the x-y plane at the intersection of the x and y axes. A vector ΔZ lying along the z-axis is used to indicate a vertical component of displacement of the thumb button 85 during depression. The y and z axes define their own plane which is perpendicular to both the x-y plane and the plane containing the blade platform 54 of the blade seat 52 regardless of whether the plane containing the blade platform 54 is parallel to, or one in the same with, the x-y plane. The purpose, therefore, of referring to the plane containing the blade platform 54 is to set the angular orientation of the z-y plane and, thereby, the Cartesian system. The Cartesian system having been set, a "path of depression having a primary component of displacement that is perpendicular to a first plane containing the longitudinal axis of the blade slide 50 which first plane is perpendicular to a second plane containing the blade platform 54" is, for the purposes of this description and the appended claims, a path whose larger vector displacement component, as between the lateral (i.e., "x") component and the vertical (i.e., "z") component is perpendicular to the z-y plane (i.e., the x-component) in FIG. 6H since the z-y plane is "a first plane containing the longitudinal axis of the blade slide 50 which first plane is perpendicular to a second plane containing the blade platform 54. For the purposes of this description, the longitudinal component of displacement during depression of the thumb button 85 is not considered; all that is necessary for the direction of depression to be "substantially lateral" is that the direction of depression be more lateral than it is vertical.

Figure 1:
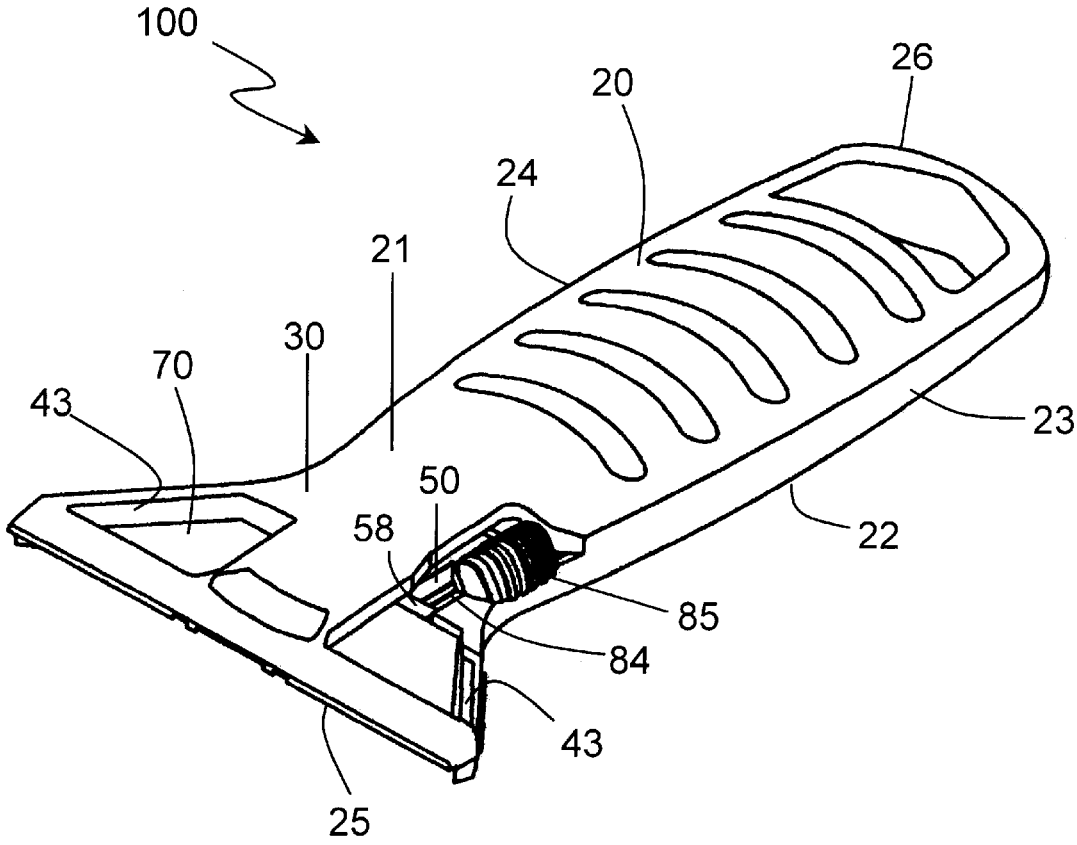
FIG. 1 is a top perspective view of a retractable blade scraper, with the blade retracted, as viewed from the front and left side.
Figure 2:
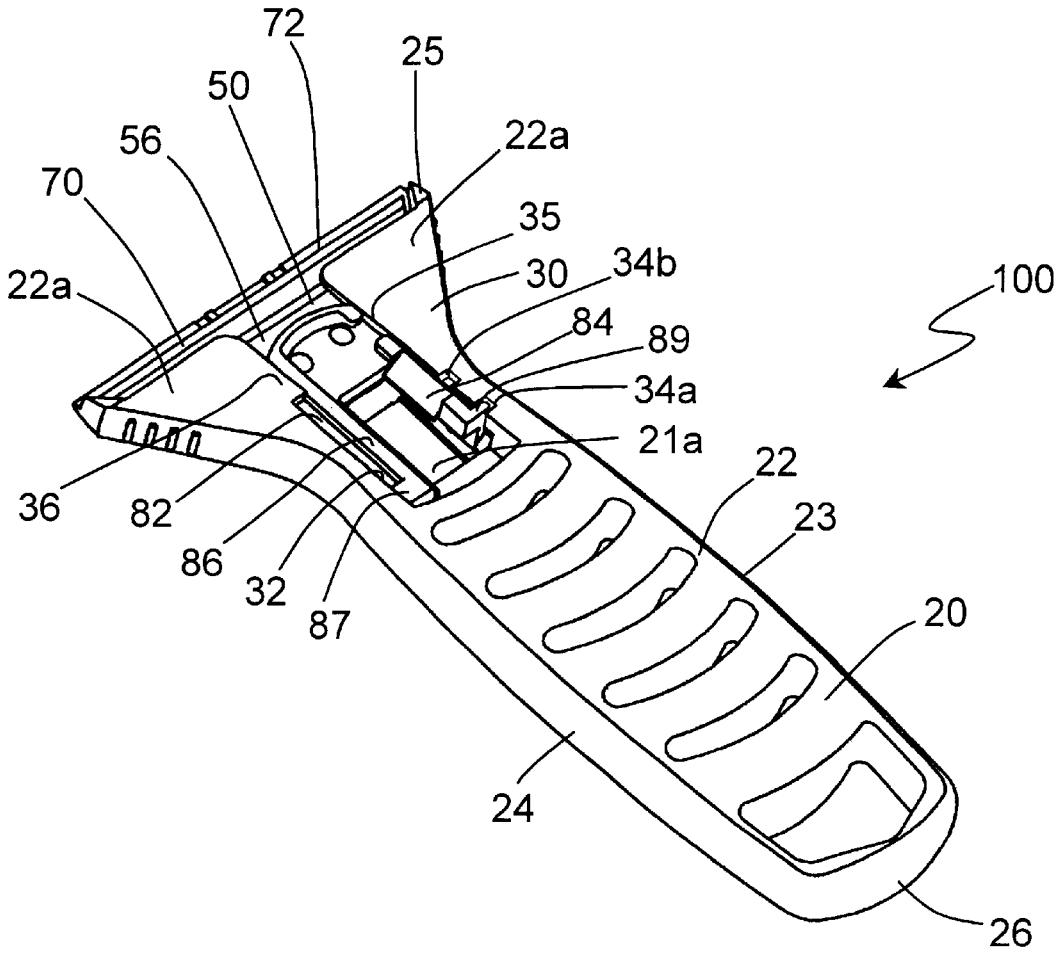
FIG. 2 is a bottom perspective view of the embodiment depicted in FIG. 1 as seen from the rear and right side.
Figure 3:
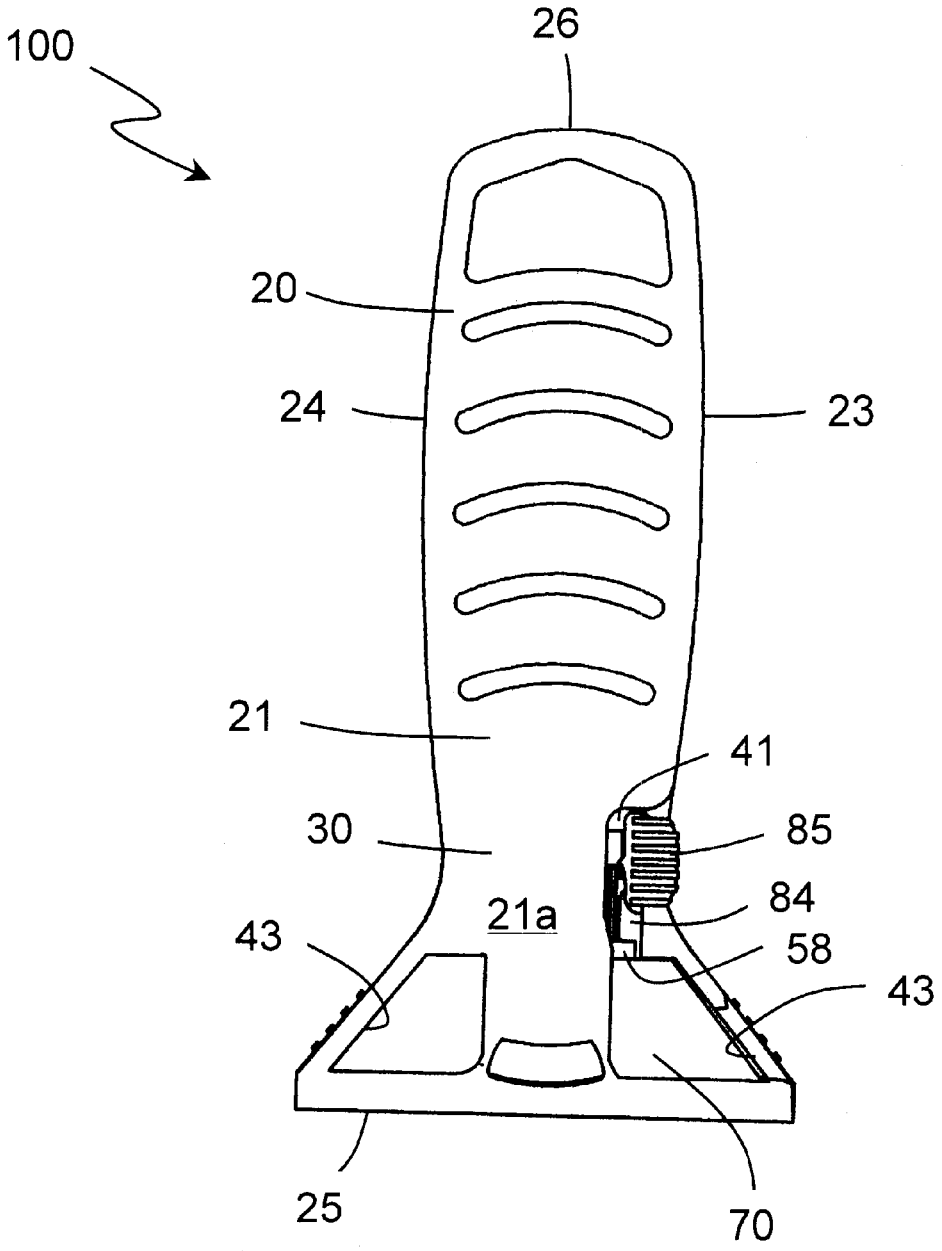
FIG. 3 is a top plan view of the embodiment depicted in FIG. 1.
Figure 4:
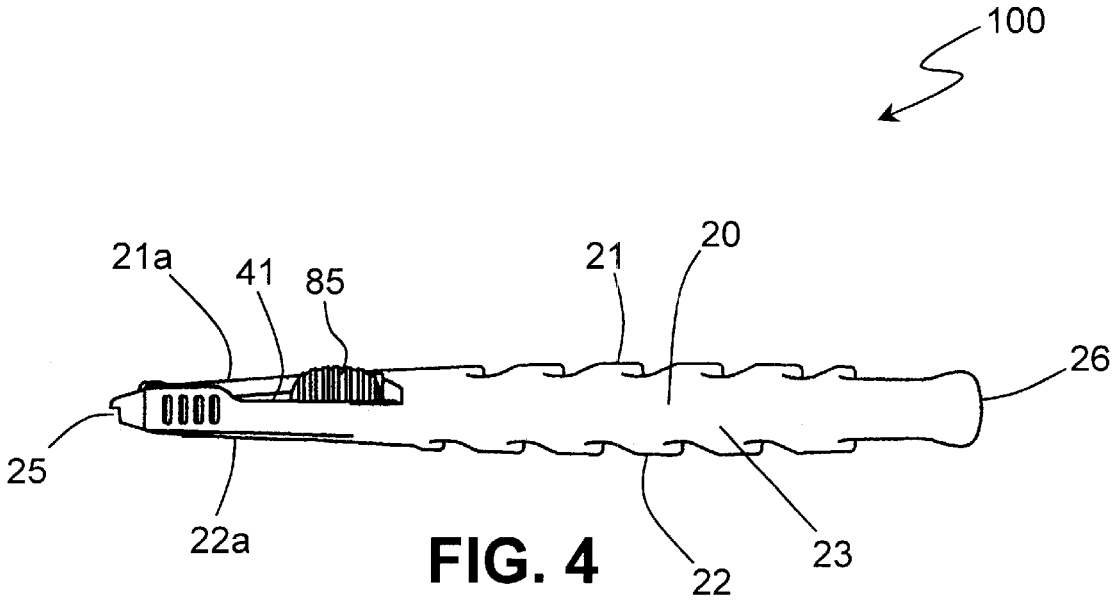
FIG. 4 is a left side view of the embodiment depicted in FIG. 1.
Figure 5:
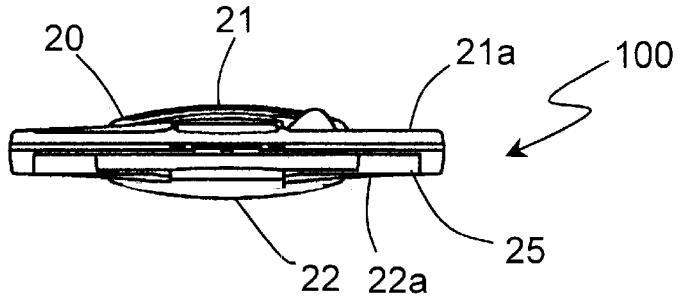
FIG. 5 is a front end view of the embodiment depicted in FIG. 1.
Figure 6A:
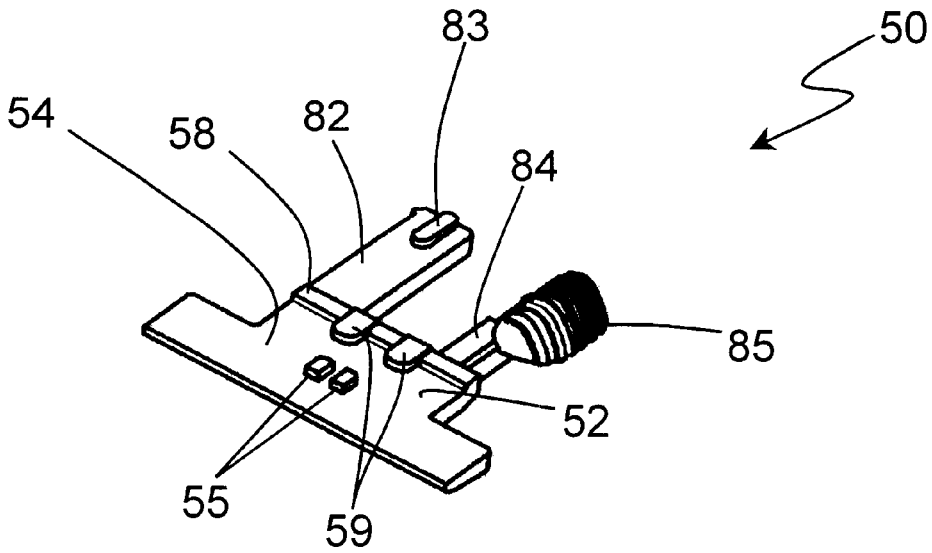
FIG. 6A is a top perspective, front end and left side view of the blade slide component of the embodiment depicted in FIG. 1.
Figure 6B:
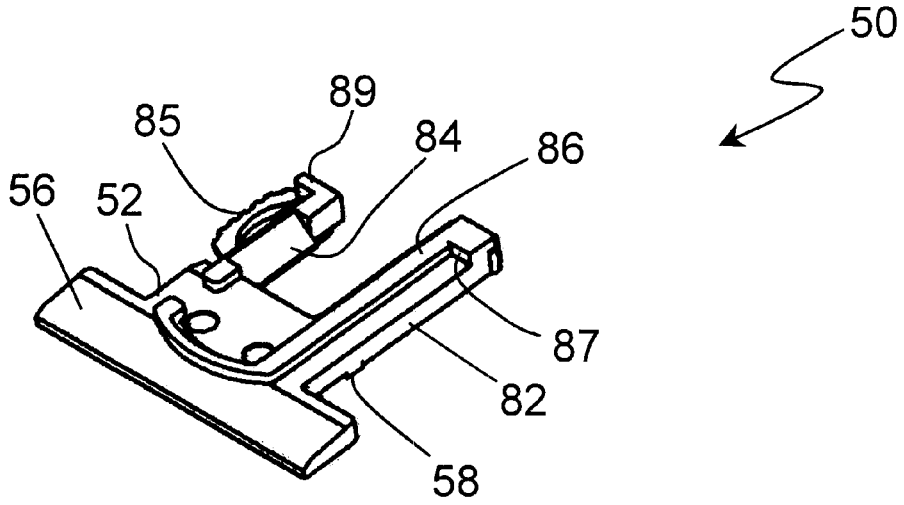
FIG. 6B is a bottom perspective, front end and right side view of the blade slide shown in FIG. 6A.
Figure 6C:
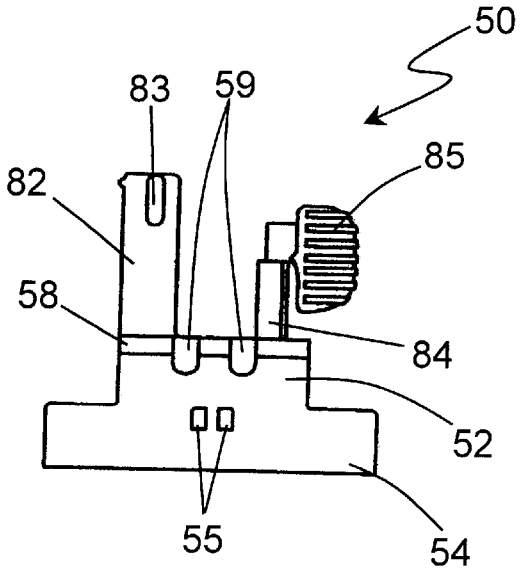
FIG. 6C is a top plan view of the blade slide depicted in FIGS. 6A and 6B.
Figure 6D:
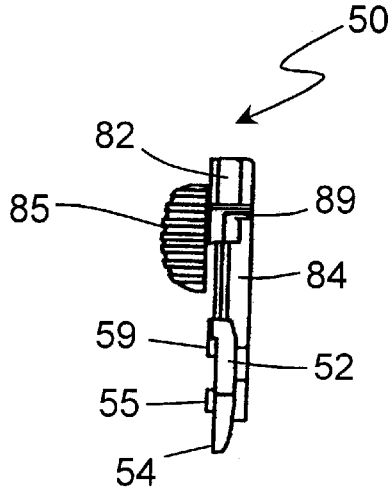
FIG. 6D is a lift side view of the blade slide depicted in FIGS. 6A through 6C.
Figure 6E:
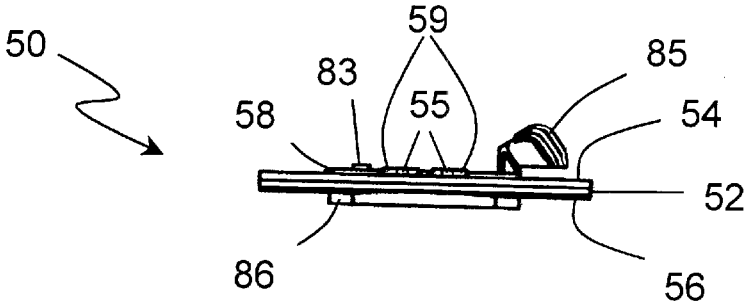
FIG. 6E is a front end view of the blade slide depicted in FIGS. 6A through 6D.
Figure 6F:
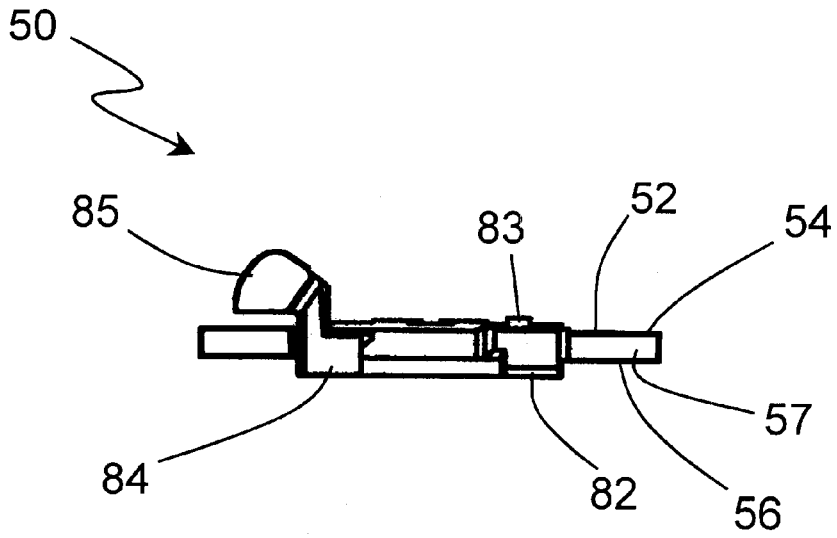
FIG. 6F is a rear end view of the blade slide depicted in FIGS. 6A through 6E.
Figure 6G:
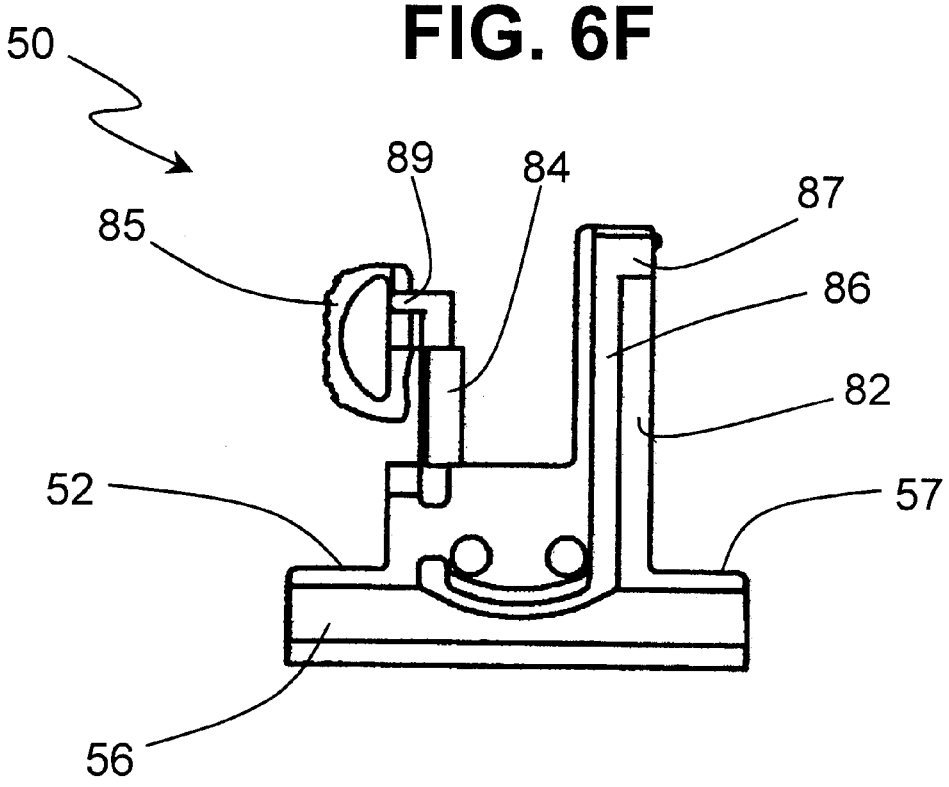
FIG. 6G is a bottom plan view of the blade slide depicted in FIGS. 6A through 6F.
Figure 6H:
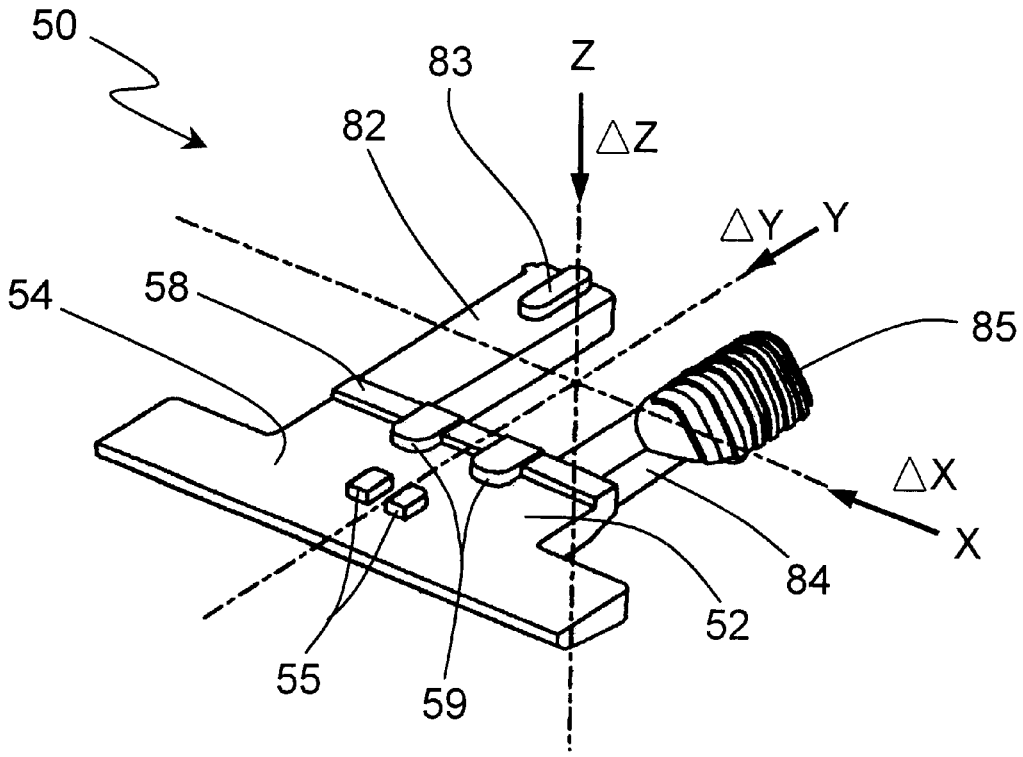
FIG. 6H is a top perspective, front end and left side view of the blade slide component depicted in FIGS. 6A through 6G with Cartesian coordinate axes superimposed thereover for the purposes of illustrating and discussing the directions of motion of the thumb button.
Figure 7A:
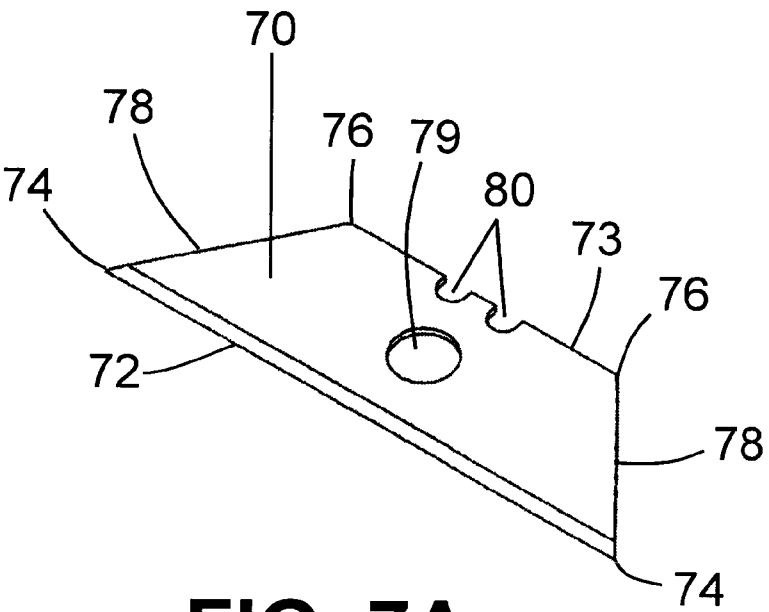
FIG. 7A is a top perspective view of a trapezoidal utility blade, as seen from the front end and left side.
Figure 7B:
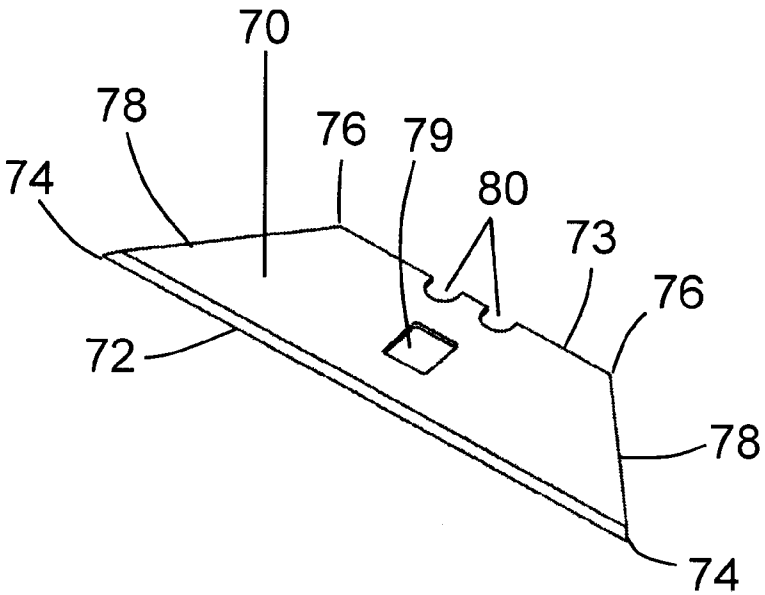
FIG. 7B is a top perspective view, of another trapezoidal utility blade.

Referring to FIGS. 6B and 6G, when the blade slide 50 is slid forward to the blade-changing position, it is prevented from moving farther forward by the contact of the seat stop 87 with the rear edge of the rigid rail guide 36 in the blade slide housing 30. In the version shown in FIG. 10B, in which there is a detent-receiving notch 34*c* corresponding to the blade-changing position, the blade slide 50 is also prevented from moving forward of this position by the contact of the slide-locking detent 89 with a rear edge of the resilient-lever guide 35. To prevent the blade 70 from springing or falling off of the blade platform 54 when the blade slide 50 is in the blade changing position, the forward translation of the blade slide arrested 50 is before the rear wall 58 of the blade seat 52 is aligned with the end of the upper surface 21 of the handle 20 and the open forward end 25. In this way, a small portion of the rear edge 73 of the blade 70 is retained within the blade slide housing 30. See FIGS. 9B and 9D. To remove the blade 70 from the blade platform 54, the user of the scraper 100 consciously grasps the blade 70 and lifts it forward and upward to dislodge it from the scraper 100. This feature provides a measure of convenience because the blade 70, under normal conditions, cannot fly from the scraper 100 and become lost.

An additional feature of one version is its ability to be used equally well irrespective of whether the upper surface 21 or the lower surface 22 of the handle 20 is face up in the user's hand. As previously discussed, this verison is substantially symmetrical and flat about its longitudinal axis. Furthermore, the thumb button 85 protrudes through the thumb button opening 41 by an amount sufficient to make it conveniently accessible from outside the housing 30, but not so much that it detracts from the overall symmetry of the scraper 100. These features facilitate the ability of the scraper 100 to be so used. Also facilitating this function is the design of the blade slide 50, specifically the blade seat 52. As illustrated in FIGS. 6A through 6H, the blade seat 52, from the rear portions of the blade-retaining lugs 55 forward, is wider than the rest of the blade seat 52. Specifically, this portion of the blade seat 52 is very near the width of the utility blade 70, at least in the vicinity of the rear edge 57 of the blade seat 52. When the scraper 100 is being used with its lower surface 22 face up in the user's hand, the force of the blade 70 against the surface to be scraped tends to lift the blade 70 upward against the blade seat 52. The width of the blade seat 52 in the vicinity previously described promotes stability of the blade 70 insofar as if the blade seat 52 were narrow relative to blade 70 in this vicinity, the blade 70 would tend to twist within the blade slide housing 30 even if only small differences in force were applied to either side of the blade 70. Further promoting this blade-stabilizing function is the fact that, when the blade slide 50 is in the scraping position, the portions of the bottom surface 56 of the blade slide 50 that are to the outside of the rigid guide arm 82 and the resilient lever 84 are in contact with the blade-seat-guiding surfaces 44 in the blade slide housing 30. This aspect of the design not only provides stability, but also provides enough rigidity to withstand a force normal to the lowermost flat surface of the blade 70 sufficient for all common scraping purposes.

In one version a scraper 100 that accomodates the opposable motion of the human thumb, it is preferable, but not essential, that the elongated thumb button opening 41 be situated partially in the upper surface 21 and partially in one of the left and right sides 23 and 24 as generally illustrated in the drawings. However, this is not essential. In an alternative version, thumb button opening 41 resides exclusively in one of the sides 23 and 24 with the thumb button 85 protruding therefrom. In still another version (not shown), the thumb button 41 is exclusively in the upper surface 21.

Figure 9A:
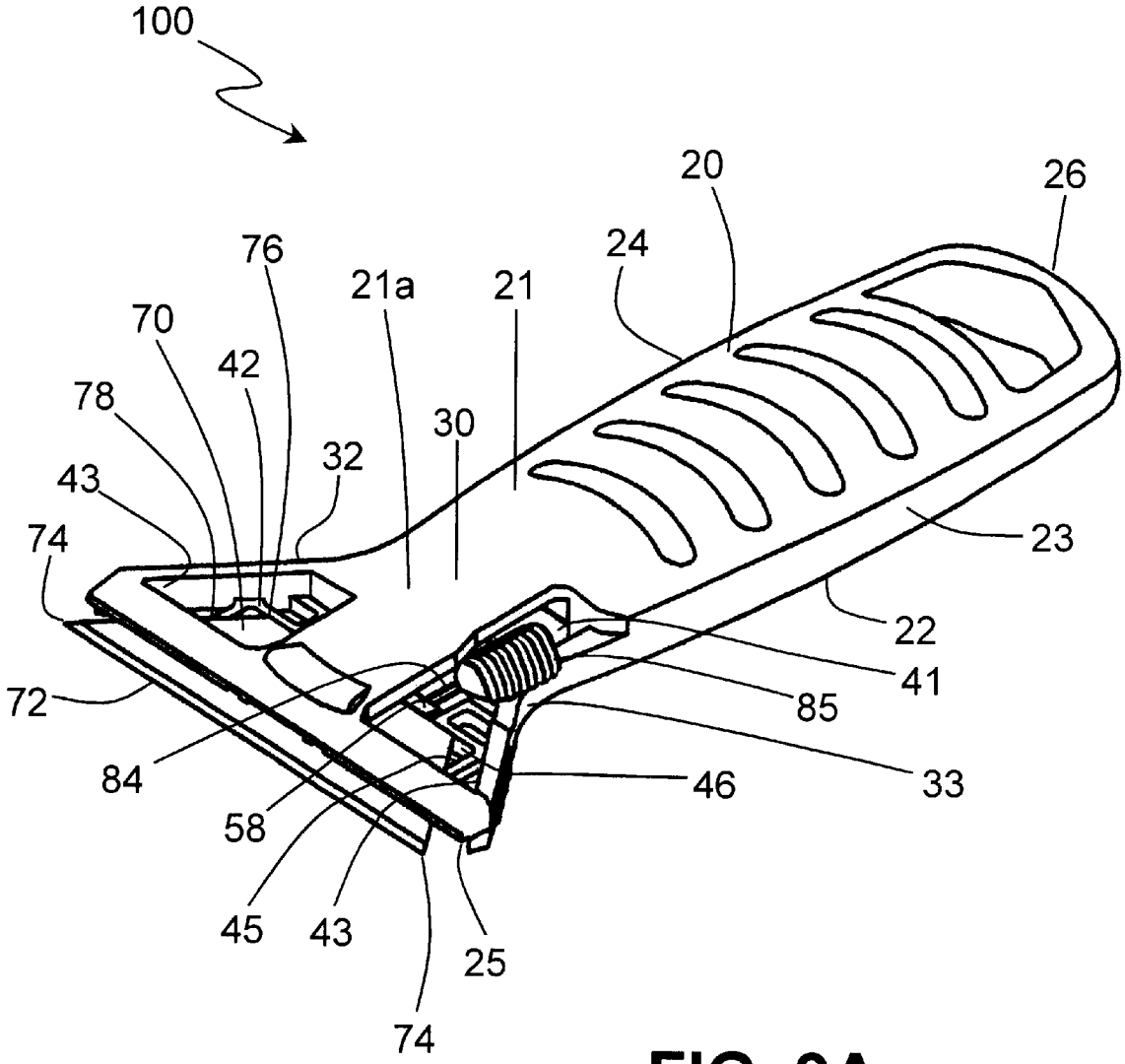
FIG. 9A is a top perspective view of a retractable blade scraper as viewed from the front and left side with a blade slide and blade in the scraping position.
Figure 9B:
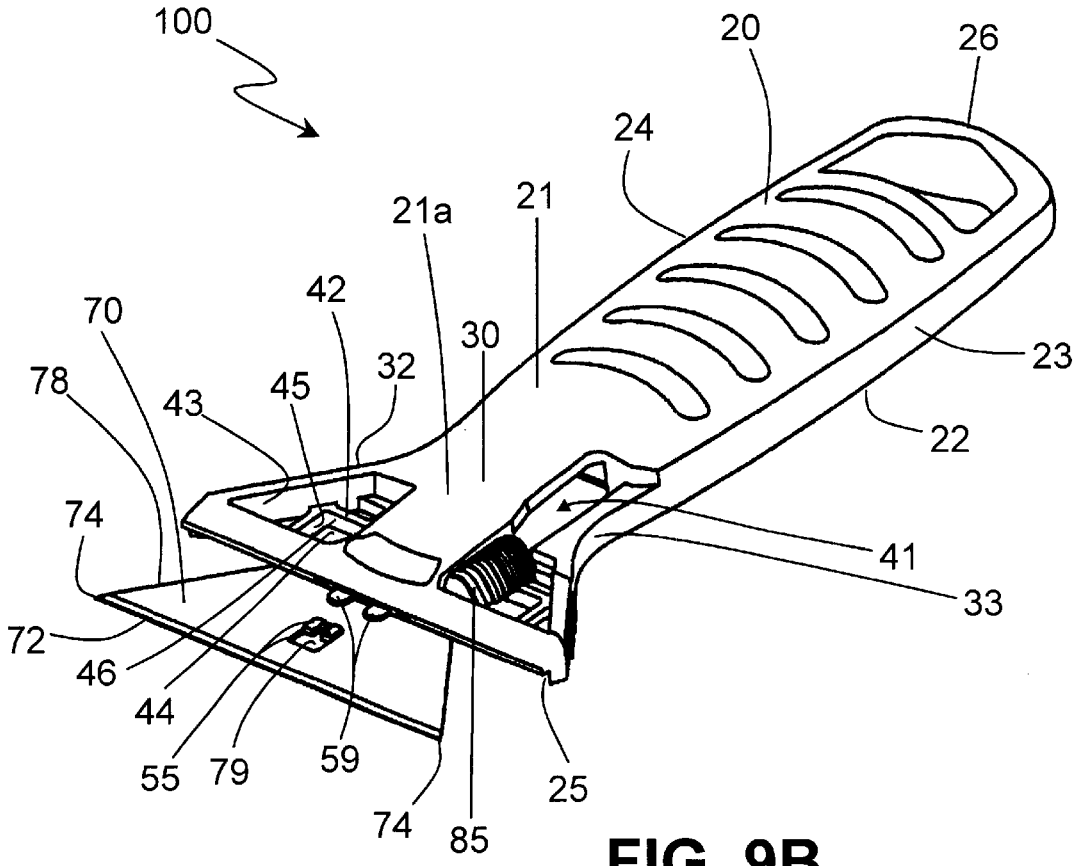
FIG. 9B is a top perspective view of the of a blade scraper shown in FIG. 9A as viewed from the front and left side with the blade slide and blade in the changing position.
Figure 9C:
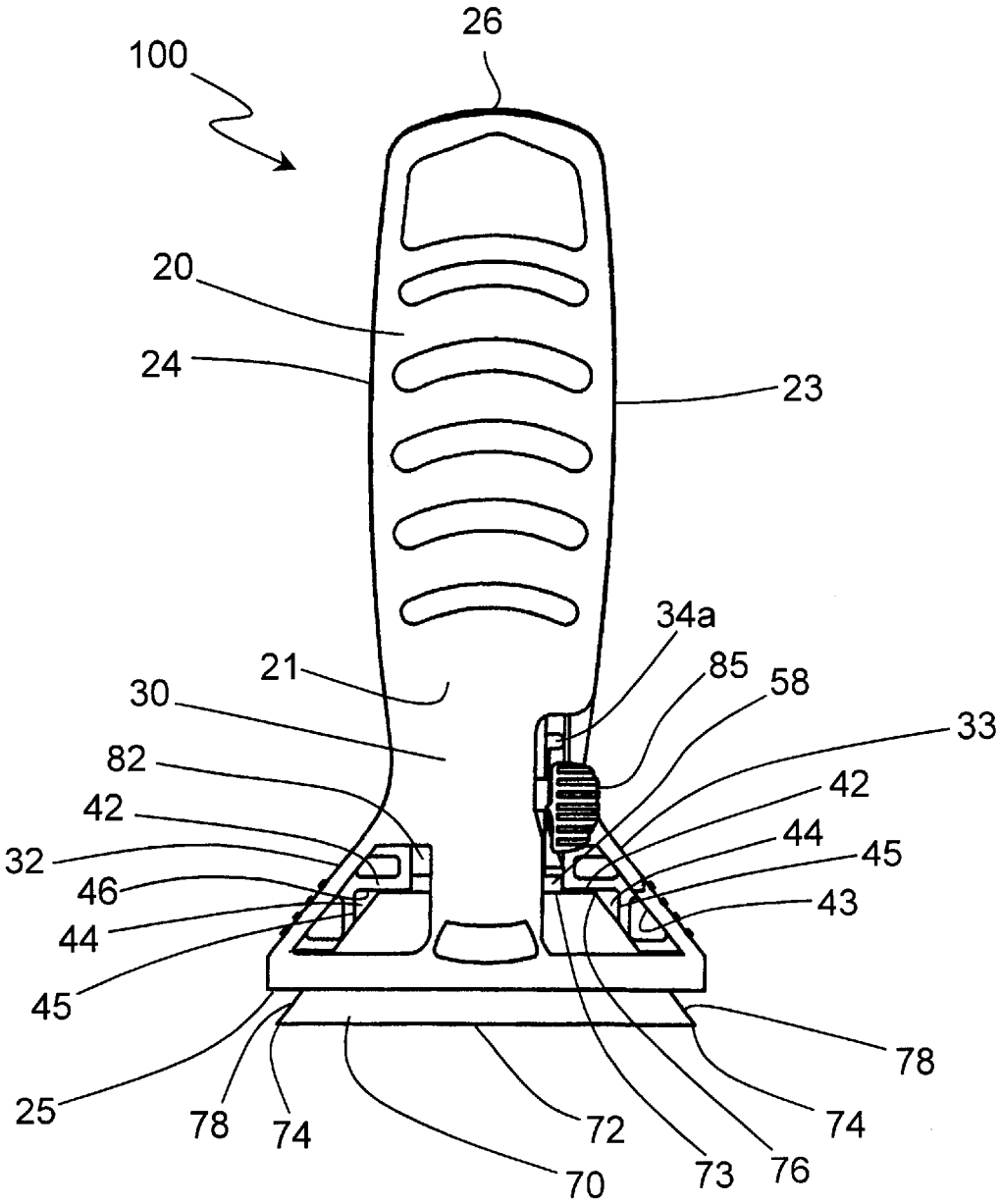
FIG. 9C is a top plan view of the retractable blade scraper depicted in FIGS. 9A and 9B with the blade slide and blade in a scraping position.
Figure 9D:
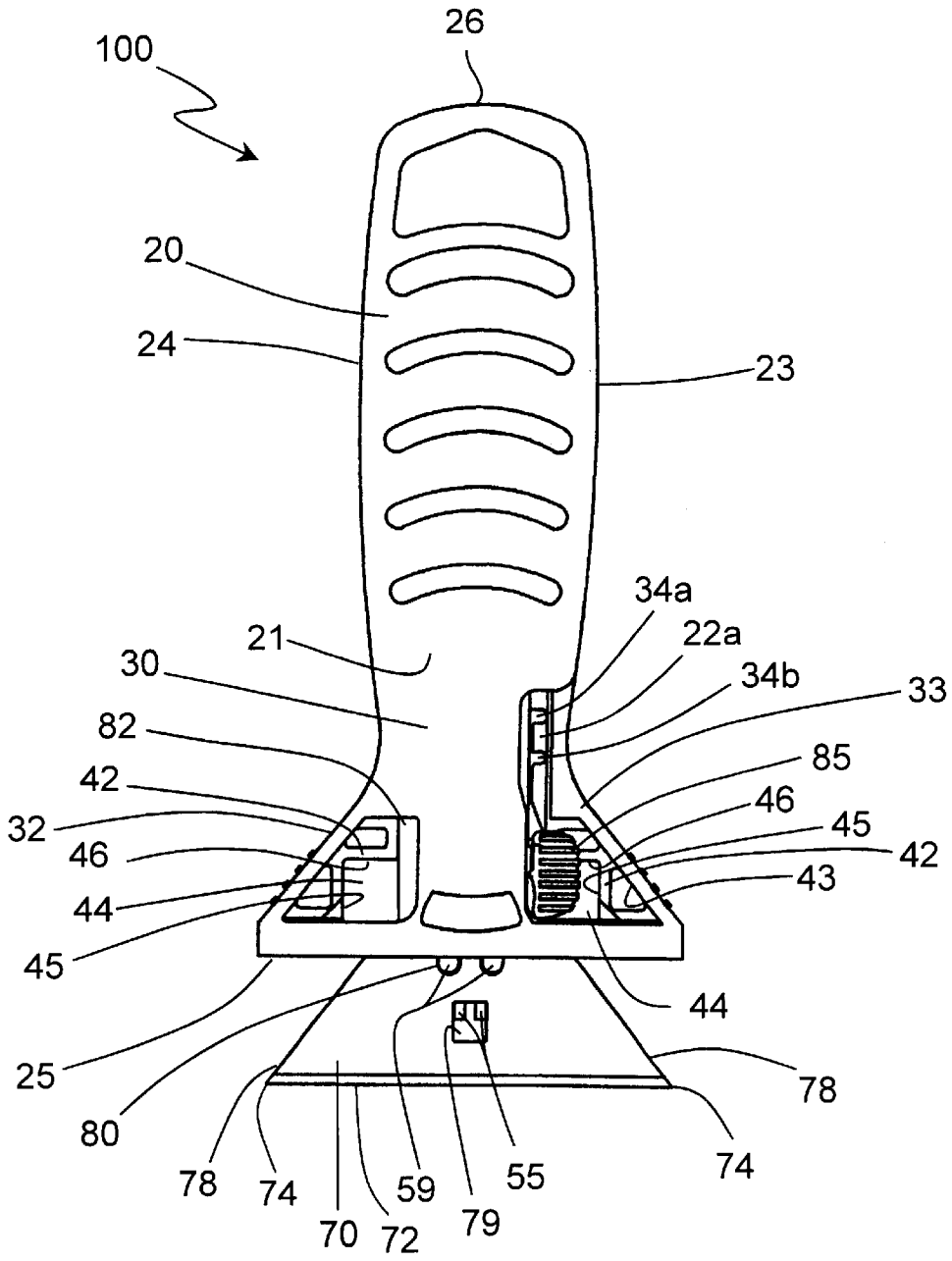
FIG. 9D is a top plan view of the embodiment depicted in FIG. 9C with the blade slide and blade in the changing position.
Figure 9E:
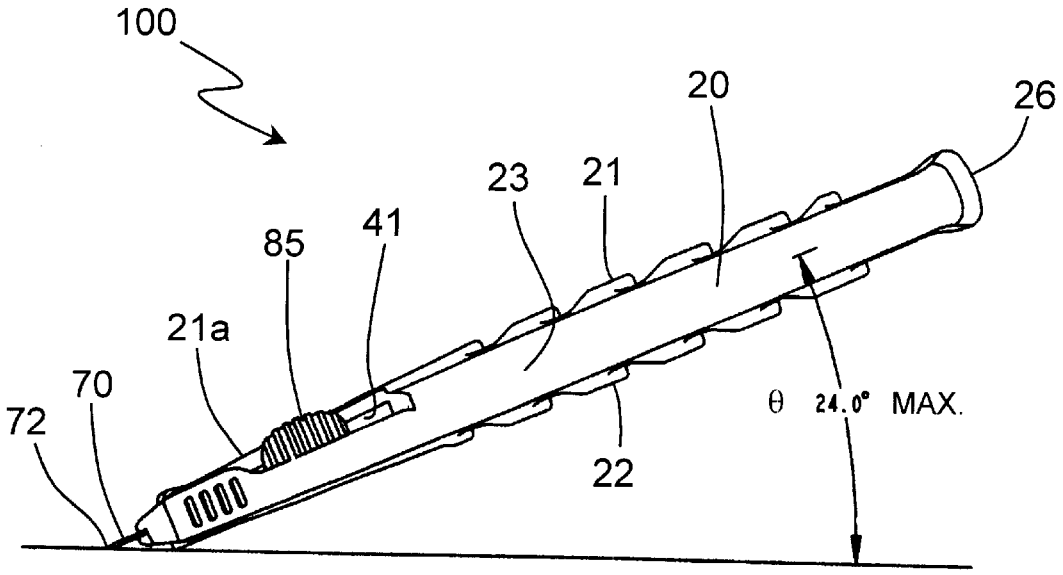
FIG. 9E is a left side view of the embodiment depicted in FIGS. 9A through 9D showing how tapering the upper and lower surfaces of the handle adjacent the open forward end facilitates scraping at a favorable, acute angle with respect to the surface being scraped.
Figure 10A:
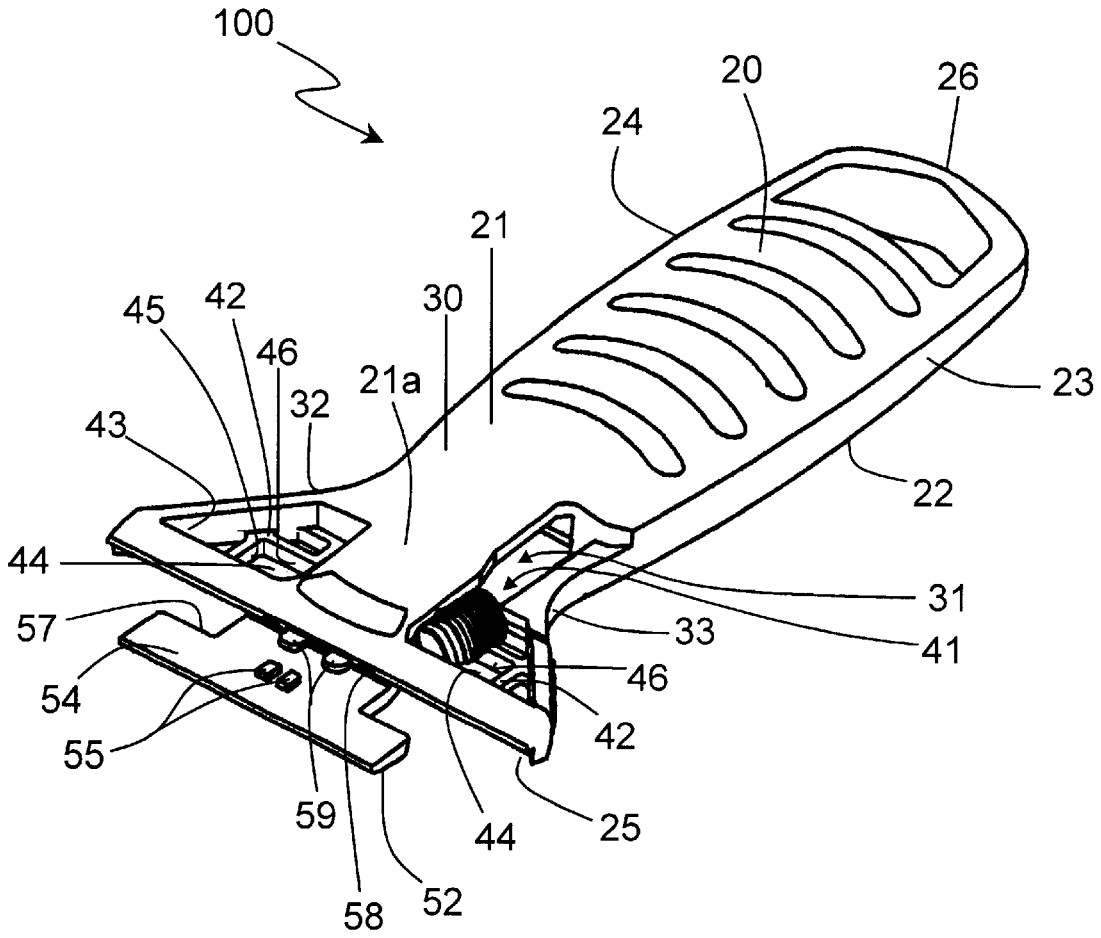
FIG. 10A is a top perspective view of the embodiment shown in FIGS. 9A through 9E with the blade slide extended to the blade changing position, but with the blade removed, as viewed from the front and left side of the scraper.
Figure 10B:
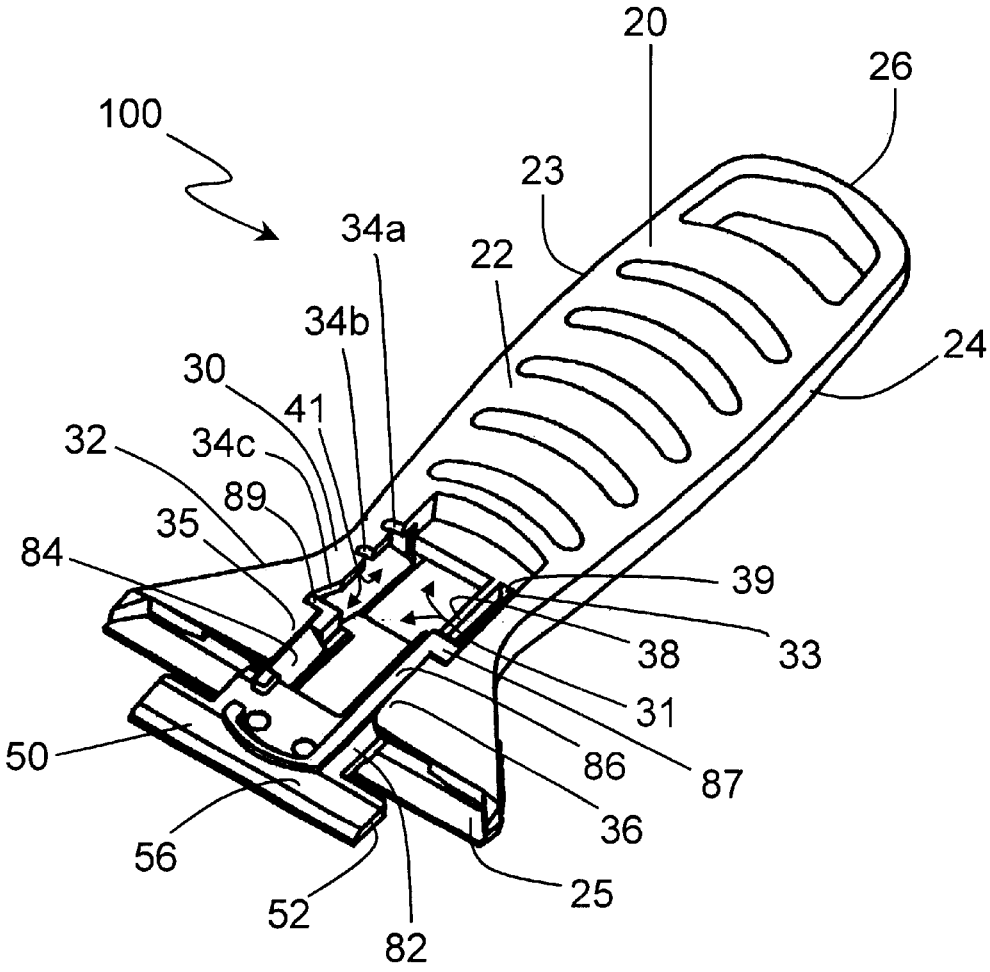
FIG. 10B is a bottom perspective view of the embodiment shown in FIG. 10A with the blade slide extended to the blade changing position, but with the blade removed, as viewed from the bottom and right side of the scraper.

To enable a user of the scraper 100 to scrape a surface at an acute angle θ between the blade 70 and the surface to be scraped, one version includes a handle 20 with upper and lower surfaces 21 and 22 that are tapered toward one another in the vicinity of the open forward end 25 as illustrated in FIG. 9E. As a general observation, the more acute the approach angle θ, the more efficiently the scraper 100 will operate to remove unwanted material. The inventor regards as advantageous approach angles θ that are less than 24° as indicated in FIG. 9E. It will be appreciated that the tapering of the upper and lower surfaces 21 and 22 of the handle 20 as described facilitates acute approach angles θ.

Reversibility of the scraper 100 and scraping at favorable approach angles θ are further enabled by a handle 20 of minimal thickness, between the upper surface 21 and the lower surface 22 of the handle 20. In one version maximum thickness between the upper and lower surfaces 21 and 22 is 9/16".

Referring to FIGS. 11 through 14C, a blade scraper 100' adapted for use with a rectangular scraping blade 70' is illustrated. In the particular embodiment illustrated in FIGS. 11 through 13, the rectangular scraping blade 70' is a razor blade such as those shown in FIGS. 14A through 14C. Alternative versions retain different types of rectangular scraping blades 70'. For example, one version is adapted for use with wallpaper scraping blades that have elongated scraping edges, generally much longer than the scraping edges of razor blades. For example, four inches is not an uncommon length for the scraping edge of a wallpaper scraping blade. However, these dimensions are offered by way of example, blade shapes and dimensions should not be interpreted as limitations on the scope of the invention as disclosed and claimed.

The detailed description set forth in connection with versions adapted for trapezoidal scraping blades 70 is generally useful for describing the versions adapted for the use with rectangular scraping blades 70' shown in FIGS. 11 to 13, for example. Therefore, reference is made to former description to complete the description of the latter versions except where specific differences between the two sets of embodiments are noted below. The reference numbers used to indicate and describe elements in the versions adapted for trapezoidal blades 70 correspond to those used for the same or analogous elements in versions adapted for rectangular blades 70', with the exception that the prime symbol (i.e., "'") appears as part of the reference numbers for the latter versions.

For the sake of brevity, only the main differences between the illustrated versions adapted for use with trapezoidal blades 70 and the illustrated versions adapted for rectangular blades 70' are discussed. One difference is that a version adapted for trapezoidal blades 70 includes diverging inner-side-wall surface 43 in order to accommodate a trapezoidal blade 70, while a version adapted for use with rectangular blades 70' includes parallel inner-side wall surfaces 43' in order to accommodate a rectangular blade 70'. For example, compare the versions of FIGS. 1 and 11. Some examples of the types of rectangular scraping blades 70' are shown in FIGS. 14A through 14C. The side edges 78' of the scraping blades 70' are parallel instead of diverging; accordingly, the corners 74' and 76' are 90° instead of acute and obtuse, respectively, like corners 74 and 76 of a trapezoidal blade 70.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed.

What is claimed is:

1. A retractable blade scraper for use with a removable scraping blade having a scraping edge, a rear edge opposite the scraping edge, side edges extending between the scraping and rear edges and two opposed flat surfaces bounded by the edges, and comprising:

(a) an elongated handle having upper and lower surfaces, left and right sides, a rear end and an open forward end, said handle including an integral blade slide housing beginning at said open forward end and extending longitudinally rearwardly toward said rear end, said blade slide housing having top, bottom, left and right walls defining a blade-slide cavity adapted to receive a scraping blade through said open forward end, said handle further including an elongated thumb button opening extending partially within one of said left and right sides of said handle, said handle being of substantially uniform thickness between said upper and lower surfaces and substantially symmetrical about the longitudinal axis of the handle as viewed from either side; and (b) a blade slide including a blade platform adapted for removably receiving and retaining a scraping blade having a scraping edge such that the scraping edge extends substantially perpendicular to the longitudinal axis of said handle, said blade slide being slidably received and normally retained in said blade slide housing for longitudinal reciprocation therein between a forwardmost blade-changing position in which said blade platform extends out of the blade-slide cavity beyond said open forward end by an amount sufficient to permit the alternative removal of a scraping blade therefrom and placement of a scraping blade thereon and a rearwardmost blade-storage position in which the scraping edge of a scraping blade in place on said blade platform does not extend beyond said open forward end, said blade slide further including (i) a force actuated thumb button accessible from the exterior of said handle through said thumb button opening and connected to the remainder of said blade slide by a resilient lever, and (ii) a slide-locking detent depending from said resilient lever which is normally biased by said resilient lever for alternative locking engagement with at least a first detent-receiving notch within said handle corresponding to the blade storage position and a second detent-receiving notch within said handle corresponding to a scraping position, between the storage and blade changing positions, in which the scraping edge of a scraping blade in place on said blade platform extends beyond the open forward end of said handle, said slide-locking detent being movable into a sliding position in which it is disengaged from said detent-receiving notches by the depression of said thumb button in a substantially lateral direction toward one side of said handle so that said blade slide may be longitudinally reciprocated between the blade-changing and storage positions.

2. The retractable blade scraper of claim 1 wherein said blade slide housing includes diverging-inner-side-wall surfaces that diverge away from each other toward said open forward end of said handle so that said blade slide housing is adapted to receive and house a trapezoidal utility knife blade through said open forward end.

3. The retractable blade scraper of claim 1 wherein said blade slide housing includes parallel-inner-side-wall surfaces so that said blade slide housing is adapted to receive and house a rectangular scraping blade through said open forward end.

4. The retractable blade scraper of claim 1 wherein said handle further includes a third detent-receiving notch, corresponding to the blade-changing position of said blade slide, for locking engagement with said slide-locking detent of said blade slide.

5. The blade scraper of claim 1 wherein said upper and lower surfaces of said handle are tapered toward one another in the vicinity of said open forward end so that, when the scraping blade is extended to the scraping position, said scraper may be used for scraping at an acute angle in which the scraping blade is at an angle of at least as low as 24° with respect to the plane of the surface being scraped.

6. A retractable blade scraper for use with a removable scraping blade having a scraping edge, a rear edge opposite the scraping edge, side edges extending between the scraping and rear edges and two opposed flat surfaces bounded by the edges, and comprising:

(a) an elongated handle having upper and lower surfaces, left and right sides, a rear end and an open forward end, said handle including a blade slide housing beginning at said open forward end and extending longitudinally rearwardly toward said rear end, said blade slide housing having top, bottom, left and right walls defining a blade-slide cavity and parallel-inner-side-wall surfaces so that said blade slide housing is adapted to receive and house a rectangular scraping blade through said open forward end, said handle further including an elongated thumb button opening; and (b) a blade slide including a blade platform adapted for removably receiving and retaining a scraping blade having a scraping edge such that the scraping edge extends substantially perpendicular to the longitudinal axis of said handle, said blade slide being slidably received and normally retained in said blade slide housing for longitudinal reciprocation therein between a forwardmost blade-changing position in which said blade platform extends out of the blade-slide cavity beyond said open forward end by an amount sufficient to permit the alternative removal of a scraping blade therefrom and placement of a scraping blade thereon and a rearwardmost blade-storage position in which the scraping edge of a scraping blade in place on said blade platform does not extend beyond said open forward end, said blade slide further including (i) a force actuated thumb button accessible from the exterior of said handle through said thumb button opening and connected to the remainder of said blade slide by a resilient lever, and (ii) a slide-locking detent depending from said resilient lever which is normally biased by said resilient lever for alternative locking engagement with at least a first detent-receiving notch within said handle corresponding to the blade storage position and a second detent-receiving notch within said handle corresponding to a scraping position, between the storage and blade changing positions, in which the scraping edge of a scraping blade in place on said blade platform extends beyond the open forward end of said handle, said slide-locking detent being movable into a sliding position in which it is disengaged from said detent-receiving notches by the depression of said thumb button in a substantially lateral direction toward one side of said handle so that said blade slide may be longitudinally reciprocated between the blade-changing and storage positions.

7. The blade scraper of claim 6 wherein said upper and lower surfaces of said handle are tapered toward one another in the vicinity of said open forward end so that, when the scraping blade is extended to the scraping position, said scraper may be used for scraping at an acute angle in which the scraping blade is at an angle of at least as low as 24° with respect to the plane of the surface being scraped.

8. The blade scraper of claim 6 wherein the elongated thumb button opening extends partially within one of said left and right sides of said handle.

9. The retractable blade scraper of claim 6 wherein said upper surface of said handle extends over the rear edge of a scraping blade mounted on said blade platform, when said blade slide is in the blade changing position, by an amount sufficient to prevent the blade from inadvertently dismounting from said blade platform.

10. The retractable blade scraper of claim 6 wherein the thumb button opening extends partially in the upper surface of said handle and one of the left and right sides of said handle.

11. A retractable blade scraper for use with a removable scraping blade having a scraping edge, a rear edge opposite the scraping edge, side edges extending between the scraping and rear edges and two opposed flat surfaces bounded by the edges, and comprising:

(a) an elongated handle having upper and lower surfaces, left and right sides, a rear end and an open forward end, said handle including an integral blade slide housing beginning at said open forward end and extending longitudinally rearwardly toward said rear end, said blade slide housing having top, bottom, left and right walls defining a blade-slide cavity adapted to receive a scraping blade through said open forward end, said housing further including an elongated thumb button opening extending partially in said top wall of said housing and partially in one of said left and right walls; and (b) a blade slide having a longitudinal axis and including a blade platform adapted for removably receiving and retaining a scraping blade having a scraping edge such that the scraping edge extends substantially perpendicular to the longitudinal axis of said handle, said blade slide being slidably received and normally retained in said blade slide housing for longitudinal reciprocation therein between a forwardmost blade-changing position in which said blade platform extends out of the blade-slide cavity beyond said open forward end by an amount sufficient to permit the alternative removal of a scraping blade therefrom and placement of a scraping blade thereon and a rearwardmost blade-storage position in which the scraping edge of a scraping blade in place on said blade platform does not extend beyond said open forward end, said blade slide further including (i) a force actuated thumb button accessible from the exterior of said housing through, and longitudinally reciprocable within, said thumb button opening and connected to the remainder of said blade slide by a resilient lever, and (ii) a slide-locking detent depending from said resilient lever which is normally biased by said resilient lever for alternative locking engagement with at least a first detent-receiving notch within said housing corresponding to the blade storage position and a second detent-receiving notch within said housing corresponding to a scraping position, between the storage and blade changing positions, in which the scraping edge of a scraping blade in place on said blade platform extends beyond the open forward end of said handle, said slide-locking detent being movable into a sliding position in which it is disengaged from said detent-receiving notches by the depression of said thumb button along a path of depression having a primary component of displacement that is perpendicular to a first plane containing the longitudinal axis of said blade slide which first plane is perpendicular to a second plane containing said blade platform.

12. The retractable blade scraper of claim 11 wherein said handle is of substantially uniform thickness between said upper and lower surfaces of said handle, and substantially symmetrical about its longitudinal axis as viewed from either side, so that said scraper may be used with equal facility when either of said upper surface and said lower surface of said handle is face up in a user's hand, so that either of the two opposed flat surfaces of the scraping blade contained therein can be used to scrape a surface without the user's having to remove the scraping blade from said scraper to flip it over within said scraper when the scraping edge adjacent one surface of the blade is worn out.

13. The blade scraper of claim 12 wherein said upper and lower surfaces of said handle are tapered toward one another in the vicinity of said open forward end so that, when the scraping blade is extended to the scraping position, said scraper may be used for scraping at an acute angle in which the scraping blade is at an angle of at least as low as 24° with respect to the plane of the surface being scraped.

14. The retractable blade scraper of claim 11 wherein said blade slide housing includes diverging-inner-side-wall surfaces that diverge away from each other toward said open forward end of said handle so that said blade slide housing is adapted to receive and house a trapezoidal utility knife blade through said open forward end.

15. The retractable blade scraper of claim 11 wherein said blade slide housing includes parallel-inner-side-wall surfaces so that said blade slide housing is adapted to receive and house a rectangular scraping blade through said open forward end.

16. The retractable blade scraper of claim 13 wherein said blade slide housing includes diverging-inner-side-wall surfaces that diverge away from each other toward said open forward end of said handle so that said blade slide housing is adapted to receive and house a trapezoidal utility knife blade through said open forward end.

17. The retractable blade scraper of claim 13 wherein said blade slide housing includes parallel-inner-side-wall surfaces so that said blade slide housing is adapted to receive and house a rectangular scraping blade through said open forward end.

18. The retractable blade scraper of claim 11 wherein said blade slide further includes at least one of a blade-retaining lug for projecting through and engaging an at least one lug-engaging aperture through the opposed flat surfaces of the scraping blade and a blade shoulder for projecting into and engaging an at least one blade-shoulder cutout in one of the edges of the scraping blade for restraining motion of the scraping blade with respect to said blade slide when the blade is removably mounted thereon.

19. The retractable blade scraper of claim 18 wherein said upper surface of said handle extends over the rear edge of a scraping blade mounted on said blade platform, when said blade slide is in the blade changing position, by an amount sufficient to prevent the blade from inadvertently dismounting from said blade platform.

20. The retractable blade scraper of claim 11 wherein said housing further includes a third detent-receiving notch, corresponding to the blade-changing position of said blade slide, for locking engagement with said slide-locking detent of said blade slide.

* * * * *